US008562244B2

(12) United States Patent
D'Almeida

(10) Patent No.: US 8,562,244 B2
(45) Date of Patent: Oct. 22, 2013

(54) DEVICE FOR HALTING VEHICLE TRAFFIC

(76) Inventor: Jose Carlos D'Almeida, Viseu (PT)

( * ) Notice: Subject to any disclaimer, the term of this patent is extended or adjusted under 35 U.S.C. 154(b) by 112 days.

(21) Appl. No.: 12/936,369

(22) PCT Filed: Mar. 31, 2009

(86) PCT No.: PCT/PT2009/000016

§ 371 (c)(1),
(2), (4) Date: Oct. 4, 2010

(87) PCT Pub. No.: WO2009/123485

PCT Pub. Date: Oct. 8, 2009

(65) Prior Publication Data

US 2011/0033233 A1 Feb. 10, 2011

(30) Foreign Application Priority Data

Apr. 4, 2008 (PT) ..... 104013

(51) Int. Cl.
*E01F 13/00* (2006.01)

(52) U.S. Cl.
USPC ..... 404/6; 404/9; 49/49

(58) Field of Classification Search
USPC ..... 404/6, 9–11; 49/49, 131
See application file for complete search history.

(56) References Cited

U.S. PATENT DOCUMENTS 1,563,637 A * 12/1925 Lundblad ..... 49/49
2,762,145 A * 9/1956 Rupe ..... 49/49
3,325,782 A * 6/1967 Der ..... 340/935
3,783,558 A * 1/1974 Keator ..... 49/49
4,016,679 A * 4/1977 Ellefson ..... 49/49
4,097,170 A * 6/1978 Dickinson ..... 404/6
4,101,235 A * 7/1978 Nelson ..... 404/6
4,158,514 A * 6/1979 Dickinson ..... 404/6
4,318,079 A * 3/1982 Dickinson ..... 340/928
4,325,651 A * 4/1982 Szegi ..... 404/6
5,192,158 A 3/1993 Bailey et al.
5,288,164 A * 2/1994 Nasatka ..... 404/10
5,733,063 A 3/1998 Bailey et al.
6,045,293 A * 4/2000 Dickinson ..... 404/6
2004/0190990 A1 9/2004 Blair

FOREIGN PATENT DOCUMENTS

DE 3631315 A1 4/1988
FR 2522036 A 8/1983

OTHER PUBLICATIONS

International Search Report dated Aug. 11, 2009 in corresponding international patent application No. PCT/PT2009/000016, 3 pages.

* cited by examiner

*Primary Examiner* — Matthew D Troutman
(74) *Attorney, Agent, or Firm* — Maier & Maier PLLC

(57) ABSTRACT

A device designed to be embedded in the pavement of a road for halting and/or preventing the motor vehicle traffic in an opposite direction. The device is formed by a drained box to be embedded in the pavement of a roadway and by a bank of mechanisms, that it is mounted inside the box. Inside the bank of mechanisms are defined cells formed by several vertical walls, and end walls, all walls being arranged parallel to each other and joined together by screwed rods extending through the end walls. The walls extend in the same direction as the road axis, the vertical walls and the end walls serving as support for several common horizontal shafts, and their tops serving as the support pavement for the vehicle tires. Each cell includes a driving mechanism which is activated at least by one tire of a vehicle transposing or attempting to transpose it in order to present an active obstacle to the displacement of the vehicle.

4 Claims, 38 Drawing Sheets

AB3

DEVICE FOR HALTING VEHICLE TRAFFIC

RELATED APPLICATIONS

This application is the U.S. national stage application which claims priority under 35 U.S.C. §371 to International Patent Application No.: PCT/PT2009/000016, filed on Mar. 31, 2009, which claims priority under 35 U.S.C. §119, to Portugal Patent Application No.: 104013, filed on Apr. 4, 2008, the disclosures of which are incorporated by reference herein in their entireties.

FIELD OF THE INVENTION

The present invention relates to a device for halting the motor vehicles traffic in one direction, for example, in the opposite to the allowed direction by the traffic signalling, especially, in one-way roads accessing highways.

The present invention also can be applied elsewhere, in which halting of motor vehicles movement is desired.

The invention device acts instantaneously with or without external intervention.

The device according to the invention can allow vehicles travelling in the appropriated traffic direction and reacts automatically, causing the motor vehicles immobilization which attempt to oppose a forbidden or non authorized direction, unless being disabled by mechanical command or similar.

It is frequent to come across with news of drivers travelling in the highways on the opposite direction, normally by mistake, but also by deliberated acts, what, in any case, is extremely dangerous for who is using these highways and unhappily has come to cause deadly victims.

It is also frequent some drivers trying to escape without paying the fuel supplied in gas stations, or some drivers trying to force other barriers such as gates of car parking areas.

The present invention provides, through its different embodiments, very advantageous solutions in order to mitigate situations such as described in the previous paragraph.

STATE OF THE ART

The patent EP 0149963 B1 is known from the prior art which presents a road barrier for vehicles, especially, for barring entrances and exits or narrow roadways, which design is totally different from the present invention.

There are also some devices, normally used by the police authorities in "stop operations", and police barriers in order to puncture the vehicle tyres transposing them, such as described, for example, in GB2300660, FR2760026 or FR2780077. These devices are placed on the pavement act on both directions under control of the authorities. Patent FR2723239 describes a detection system of vehicles travelling on wrong direction, associated with traffic lights and one barrier, having as main drawback the high degree of sophistication and, therefore, the high cost and also the fact of being able to cause important damages not only in the vehicle travelling on wrong direction but also in a vehicle travelling on the right direction but finding the barrier closed.

Also known are surveillance video systems connected to observation stations, which in turn impart the infractions to the police authorities. In any case there is always a period of time between the infraction detection and the vehicle immobilization which can be fateful.

The concept behind this invention is to provide a device that does not allow a driver even to start a displacement in the opposite direction to the stipulated, for example, in a highway, a highway accessing road or an urban road.

OBJECT OF THE INVENTION

A first object of the invention is to provide a simple and selective device that is imperceptible to a vehicle travelling in the right direction, and automatically without any external intervention, human or electronic, preventing the vehicle movement in the opposite direction. To this end the present invention provides puncturing means, causing the tyre to rupture and thus the vehicle immobilization.

A second object of the invention is to provide a simple and selective device, which becomes imperceptible to a vehicle travelling in the right direction, and it automatically without any external intervention, human or electronic, preventing and attempting to prevent the displacement of a vehicle in the opposite direction. To this end the present invention provides means, which can immobilize the motor vehicle by puncturing the wheel of the vehicle and simultaneously causing its elevation, causing the driving wheels to work against rollers or bumps, causing them to lose adherence on the pavement while they are torn. Since the tyre puncturing and tearing piece is removable, if removed, this object of the invention meets only the function of preventing the displacement of the driving wheels by the simulation of the rollers which originate its loss of adherence or ramps simulating bumps.

A third object of the invention is to provide a control device, either manual or motorized, for activation or inactivation of the devices object of the present invention, the action on the vehicles being the same as described in the second object of the invention, but with a less degree of vehicle elevation on the roller. In this case, if the piece causing the tyre puncture is removed, the device may only perform in the pavement the bump simulation function, depending on the achieved scale. This object of the invention is always imperceptible for vehicles travelling in a given allowed direction and it acts in vehicles attempting to travel in the opposite direction, unless it is disabled by an optional external command, which can make it imperceptible in both directions.

A fourth object of the invention is to provide a manually or motorized operated device which prevents the displacement of vehicles in one of the directions, the option being able to be reversed in an easy way. This object of the invention has a similar actuation to the foregoing disclosed, but with the possibility of selection of the direction in which is desired it becomes imperceptible. This device will always have an external command for selecting the traffic direction, which can be manual and/or motorized.

A fifth object of the invention is to provide a manually and/or motorized operated device allowing the selection of the movement interdiction direction or even the blockage in either direction or the free displacement in either direction as if there is no device. This device will always have an external command for selecting the traffic direction, which can be manually and/or motorized operated.

BRIEF DESCRIPTION OF THE DRAWINGS

The present invention will now be explained in more detail, based on its embodiments currently preferred, provided by way of no limitative examples, with help of the drawings attached, in which.

DESCRIPTION OF PREFERRED EMBODIMENTS OF THE INVENTION

Figure 1:
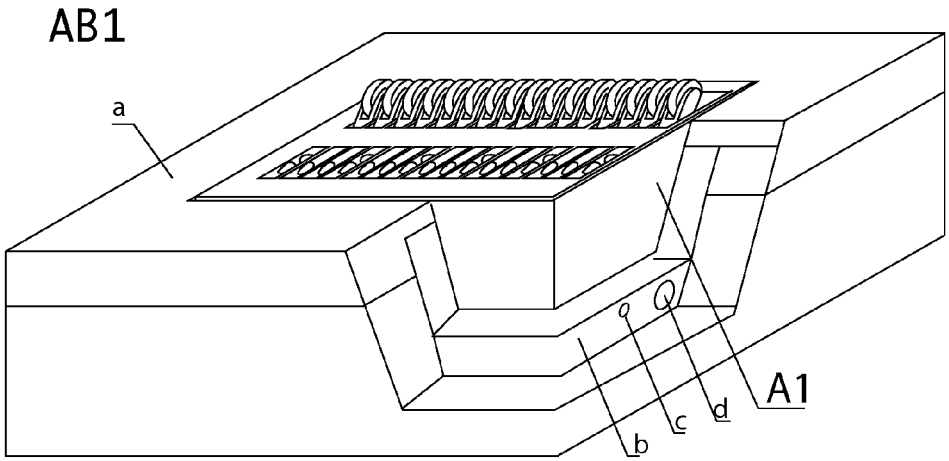
FIG. 1 schematically shows a perspective view in partial section of a first embodiment of the device according to the invention, applied on a road pavement.
Figure 2:
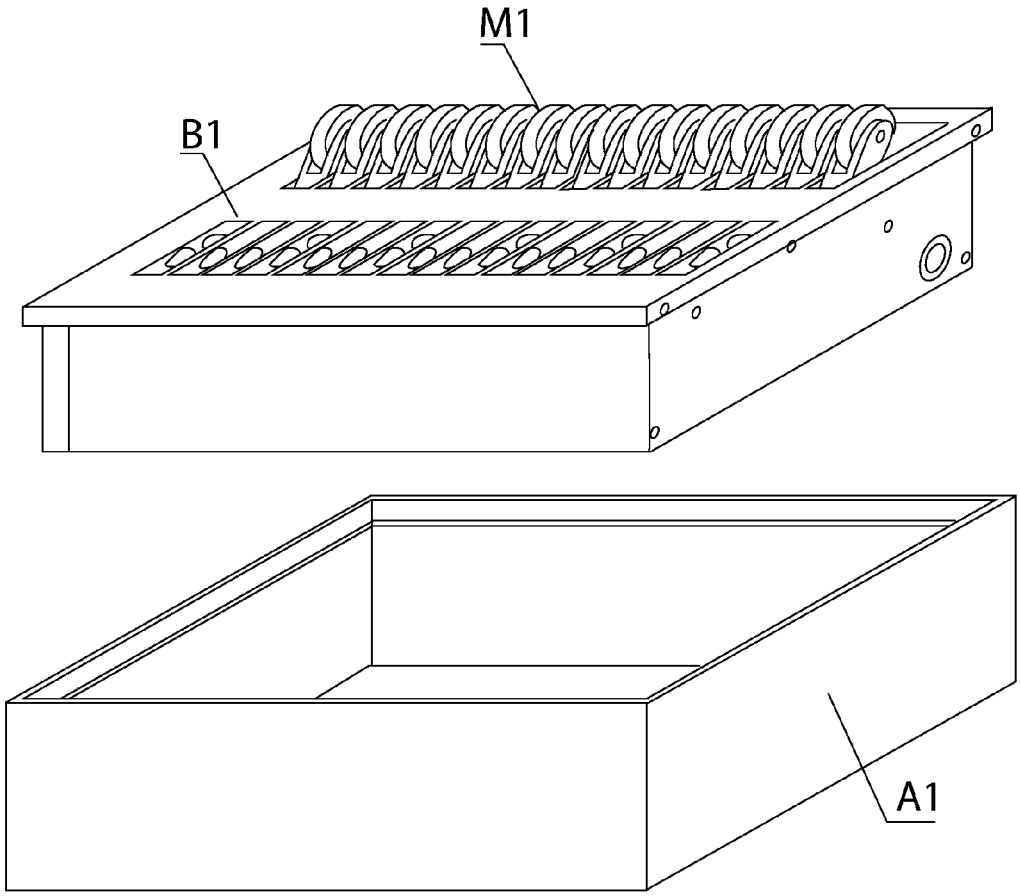
FIG. 2 schematically shows a perspective view of the support box and the bank of mechanisms separated according to the embodiment shown in FIG. 1.
Figure 3:
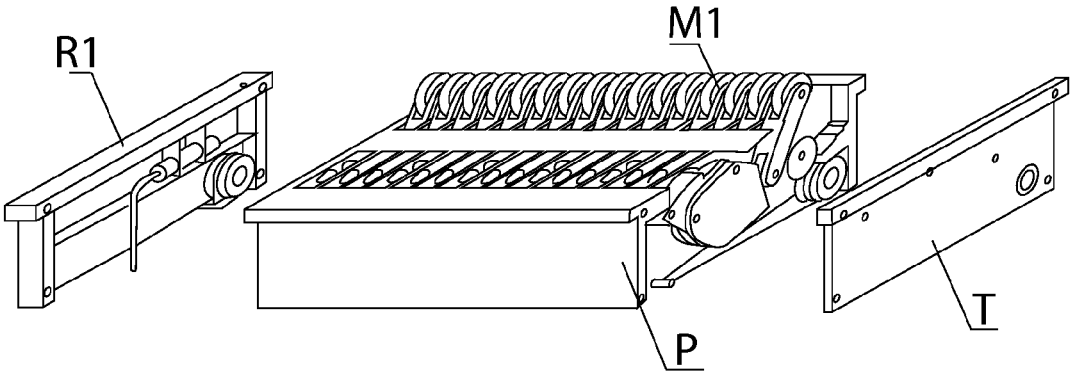
FIG. 3 schematically shows a perspective view in separate parts of the embodiment shown in FIG. 1.
Figure 4:
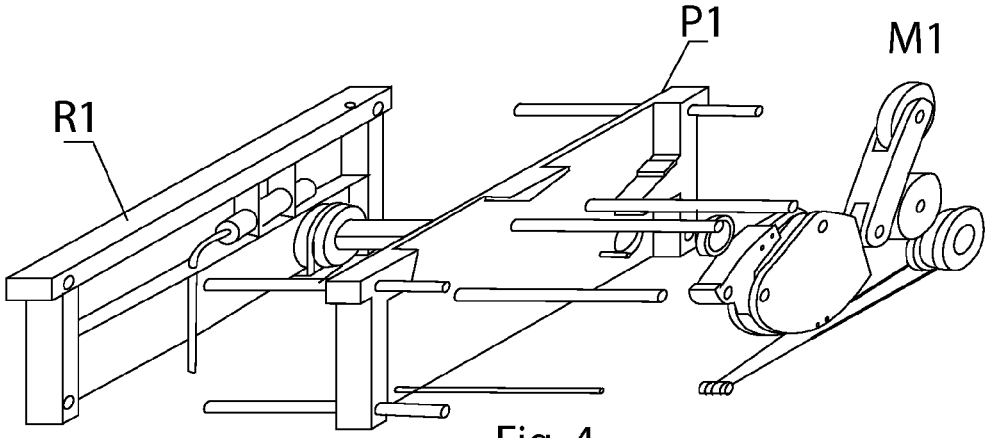
FIG. 4 schematically shows an enlarged perspective view in separate parts, in which details of the embodiment shown FIG. 1 are illustrated.
Figure 5:
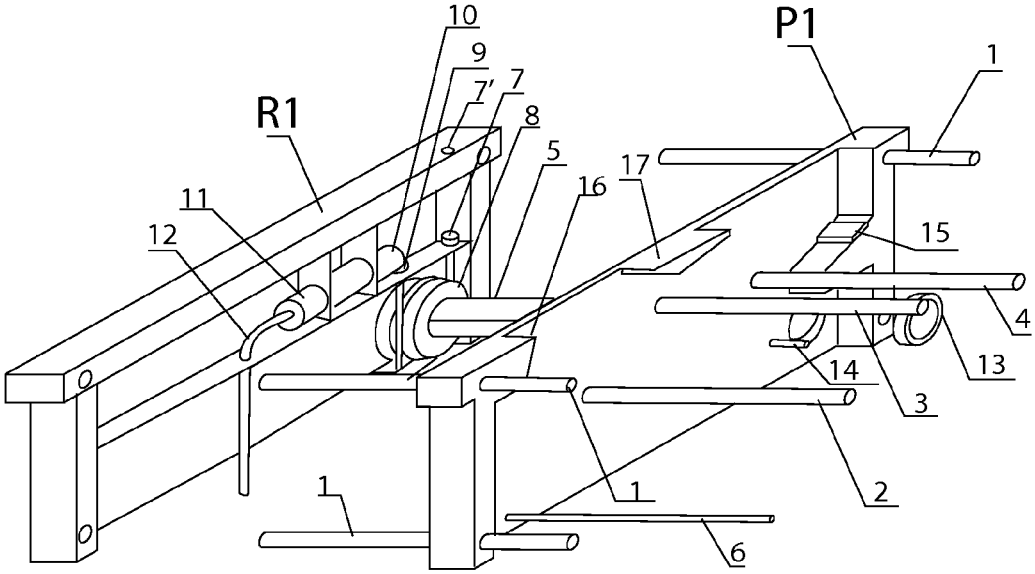
FIG. 5 schematically shows a more enlarged perspective view in separate parts, in which further details of the embodiment shown in FIG. 1 are illustrated.
Figure 16:
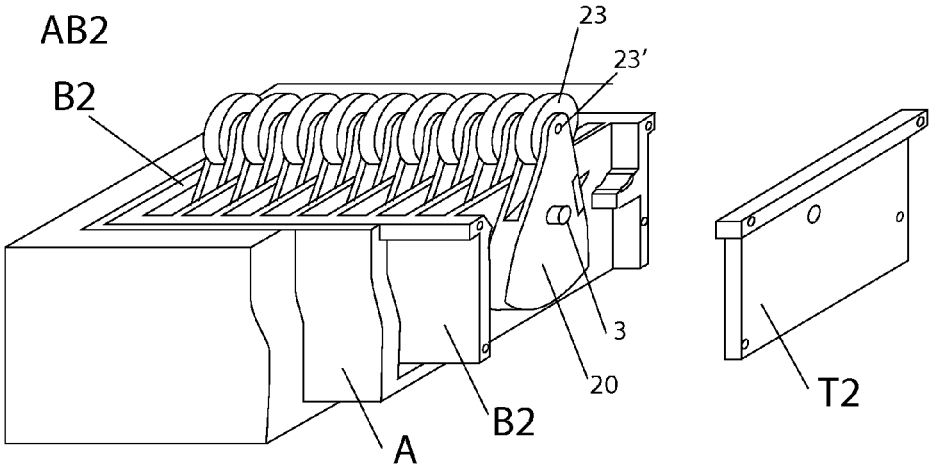
FIG. 16 schematically shows a partially cut perspective view of a second device embodiment according to the invention, applied on a road pavement.
Figure 17:
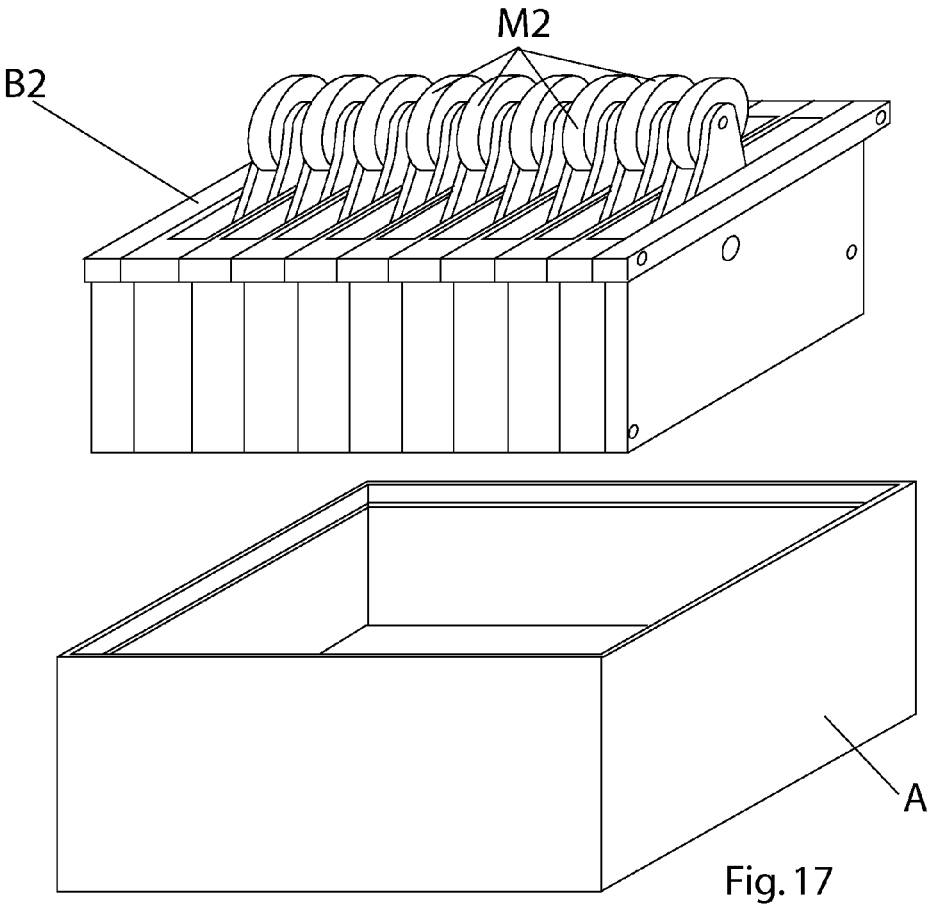
FIG. 17 schematically shows a perspective view of the support box and the bank of mechanisms separated according to the embodiment shown in FIG. 16.
Figure 18:
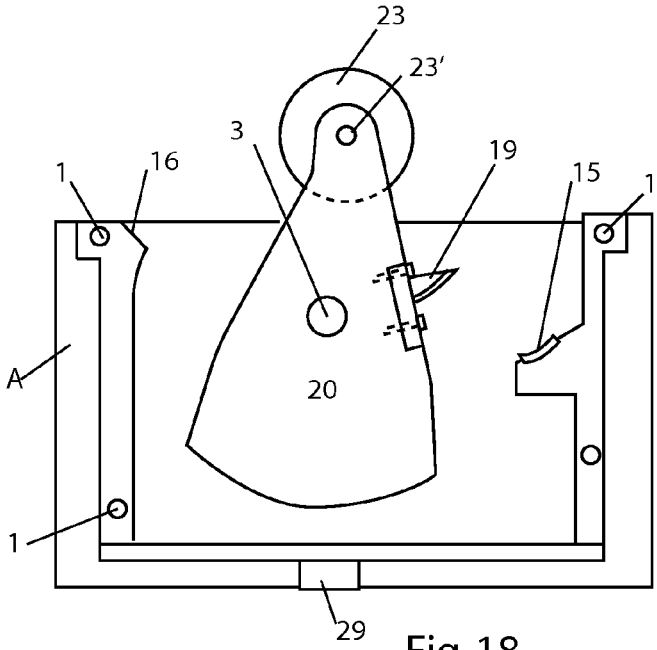
FIG. 18 schematically shows a side elevation view of a bank of mechanisms and a respective intermediate vertical wall of the embodiment shown in FIG. 16.
Figure 19:
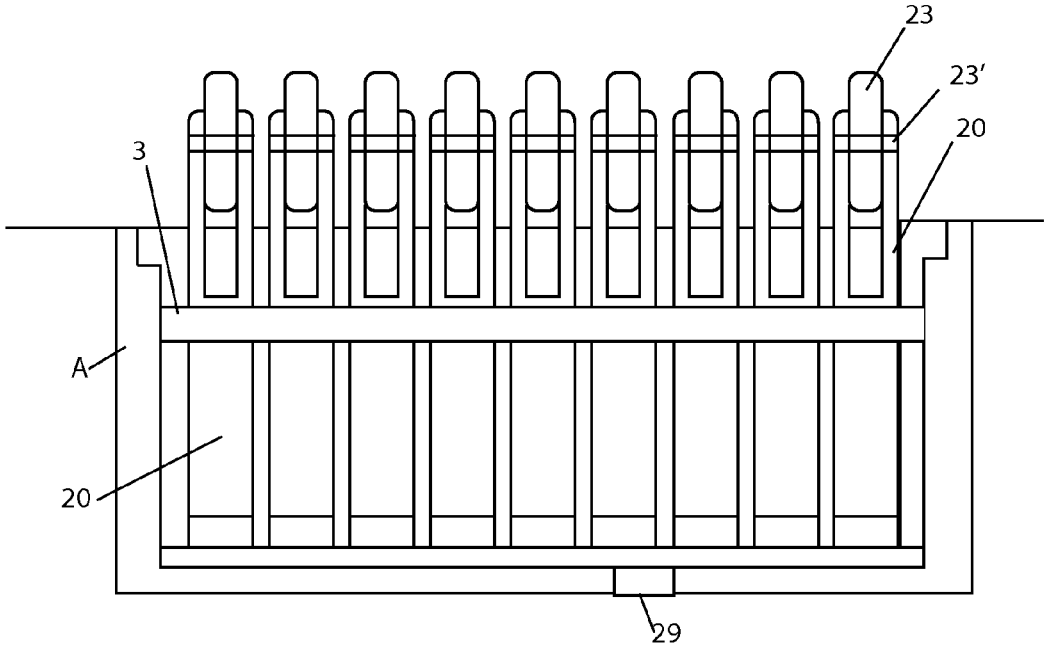
FIG. 19 schematically shows a cross-section view of the bank of mechanisms of FIG. 17.
Figure 20:
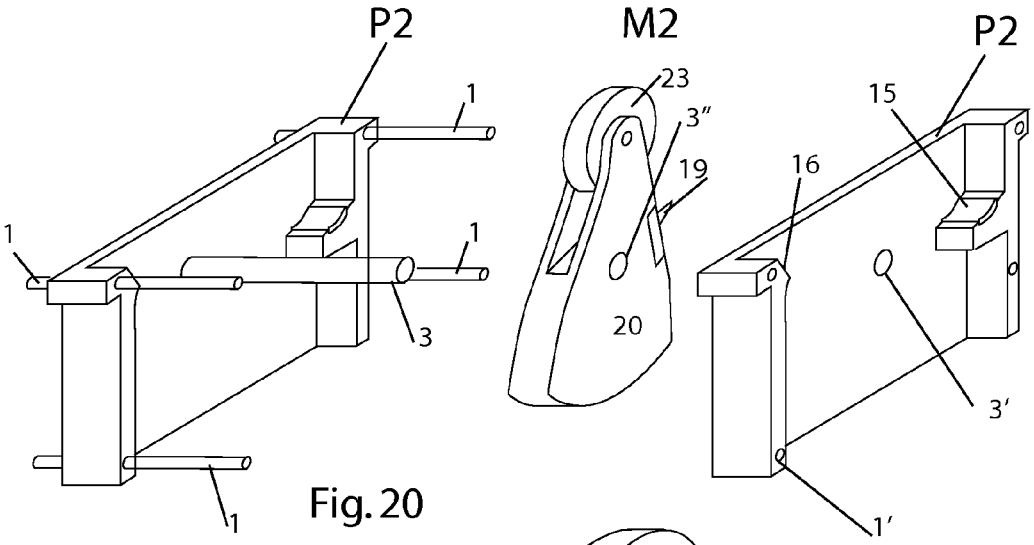
FIG. 20 schematically shows an enlarged perspective view in separate parts, in which details of the embodiment shown in FIG. 16 are illustrated.
Figure 21:
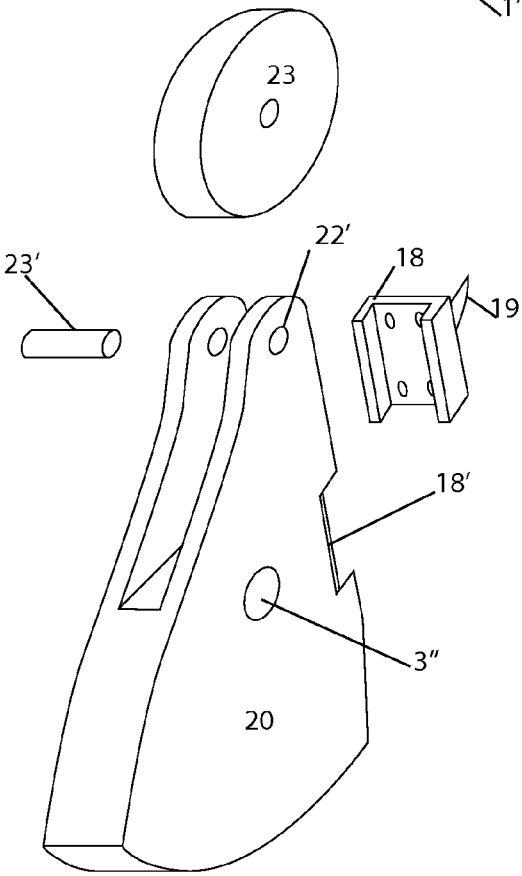
FIG. 21 schematically shows an enlarged perspective view in separate parts of the mechanism mobile piece of the embodiment shown in FIG. 16.
Figure 22:
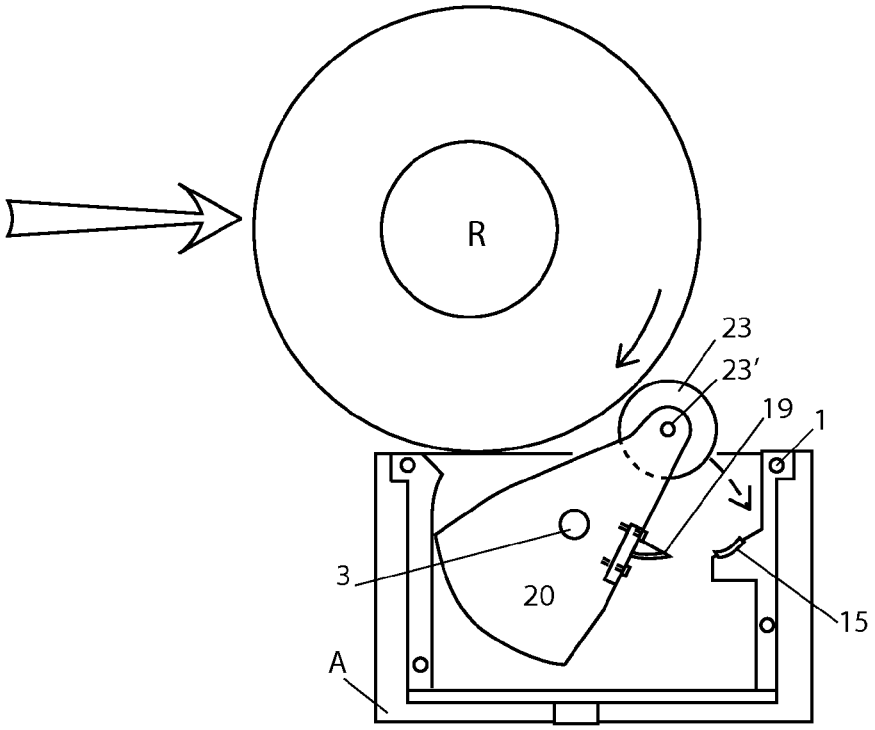
FIGS. 22 to 25 schematically show operating mode of the embodiment shown in FIG. 16.
Figure 23:
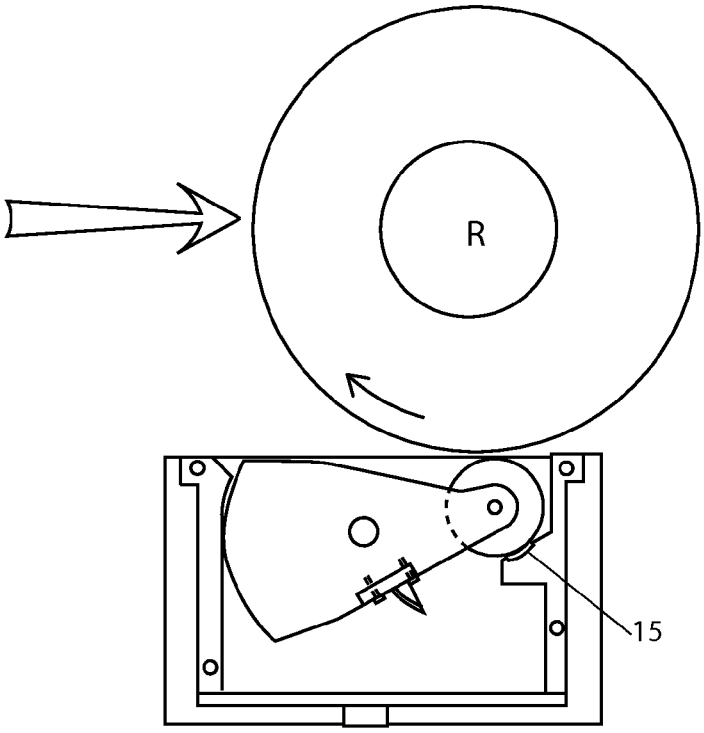
Figure 77:
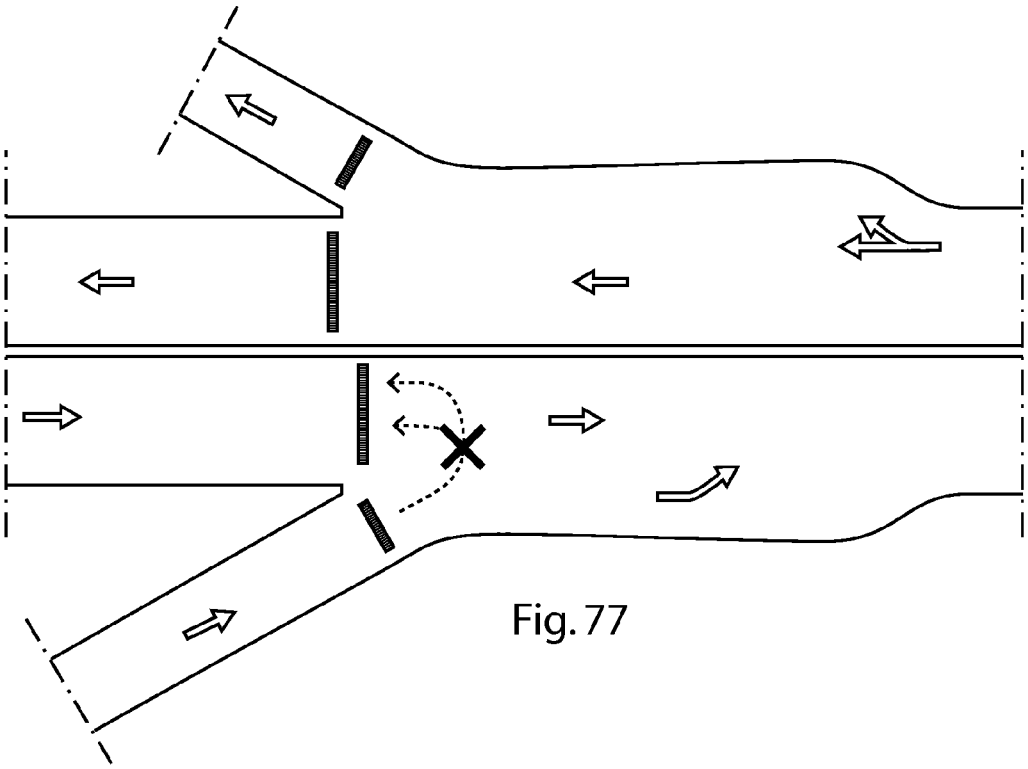
FIG. 77 schematically shows an example of application of the invention devices on roads, for example, accessing highways and on the highway itself.
Figure 78:
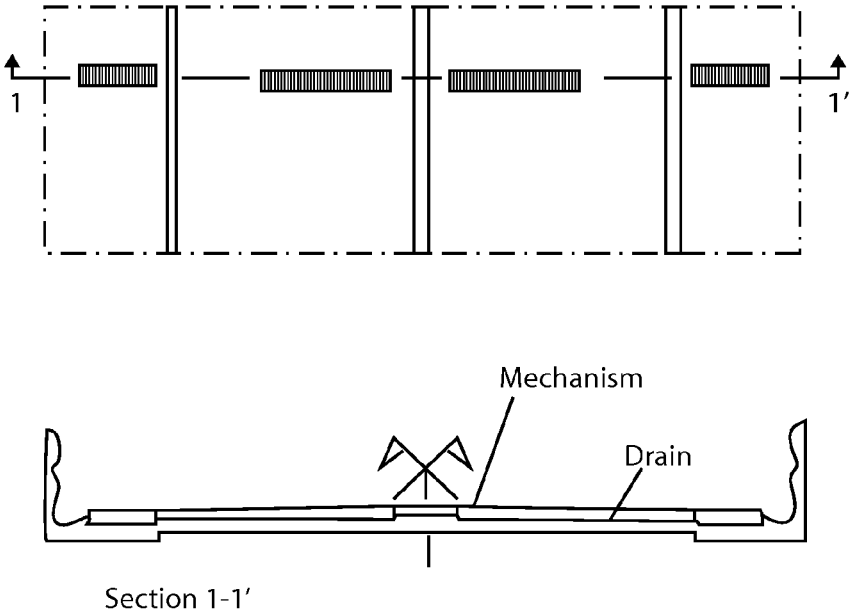
FIG. 78 shows an example of an invention devices distribution in a lane of one-way road, for example, accessing a highway both in top view and cut.

The devices depicted in the figures, which are then described, are designed to be embedded in the pavement of a road, as shown schematically in perspective and section view in the pavement, in FIGS. 1, 16 and 77, and in top view in FIGS. 77 and 78 of the drawings attached.

Figure 76:
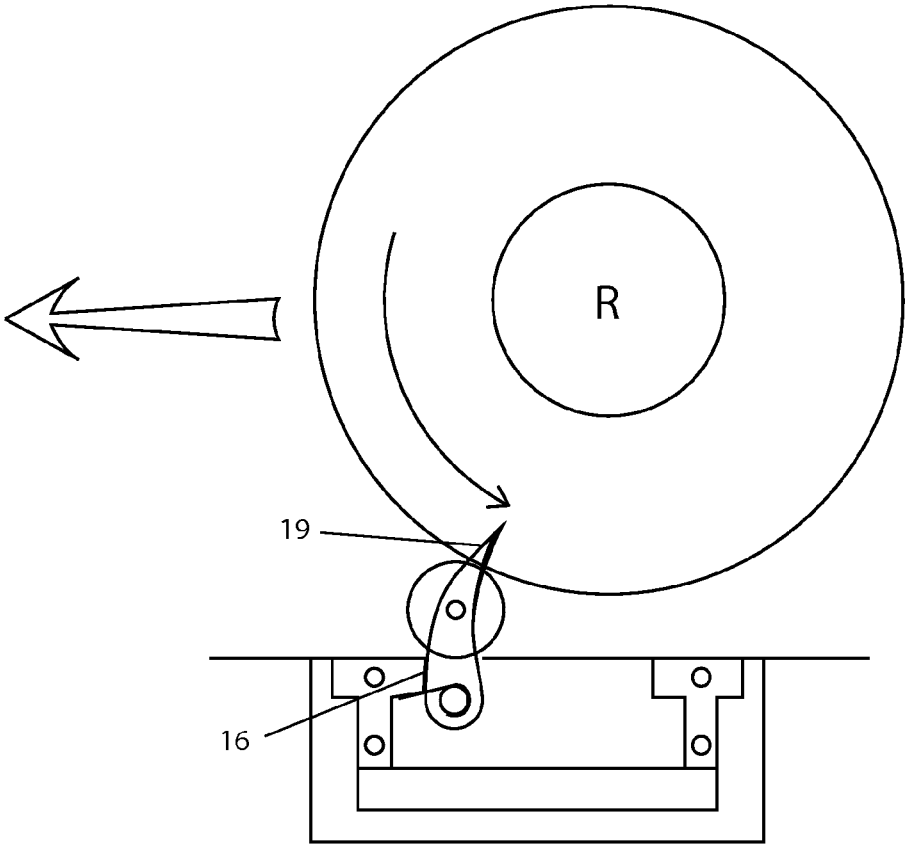

Referring to FIGS. 1 to 76 above, the component parts that are similar or correspond to the component parts illustrated in those figures are shown with the same reference numbers, for reasons of better understanding and comparative convenience.

In any of the invention device embodiments, respectively indicated by AB1, AB2, AB3, AB4, AB5, AB6 and AB7, the device consists of a box A adequately drained to embed in a road pavement, and a bank of mechanisms B1, B2, B3, B4, B5, B6 and B7 mounted within said box A. Inside the bank of mechanisms B1 to B7 there are cells defined by several vertical walls P1, P2, P3, P4, P5, P6, P7, and end walls R1, R2, R3, R4, R5, and T1, T2, T3, T4, T5, T6, T7, which are arranged parallel to each other and joined together by threaded rods 1 extending between the end walls R and T. Said walls extend in the same direction as the road axis. The vertical walls P and the end walls R and T serving as support to several common horizontal shafts 2, 3, 4, 5, etc., their tops serving as support pavement for vehicle tyres R. In each of said cells, defined by the vertical walls and by the vertical and end walls, is housed a driving mechanism M1, M2, M3, M4, M5, M6, M7.

The device AB1 to AB7 in its several embodiments, is driven by at least a vehicle tyre R attempting to transpose or transposing it, in order to form an active barrier to the displacement of said vehicle, its repositioning being done by gravity action, assisted or not by an elastic reposition arrangement, consisting for example of springs in order to reduce the reposition time, or just by action of elastic means, for example, by springs.

The invention also provides a manually controlled and/or motorized operated device for driving said mechanisms M1 to M5. In some of the embodiments in which the mechanisms are controlled by one or more control devices they may be reversible, i.e. the movement of vehicles is allowed in an optional direction.

The spikes 19 in the various embodiments of the bank of mechanisms B1 to B6 are removable and can be removed from said mechanisms M1 to M6, in which case said mechanisms only offer resistance to the displacement of vehicles, acting as rollers, which restrain the passage by loss of adherence to the driving wheel, or ramps simulating the effect of a bump, depending on the scale, without damaging the vehicle tyres R.

Figure 6:
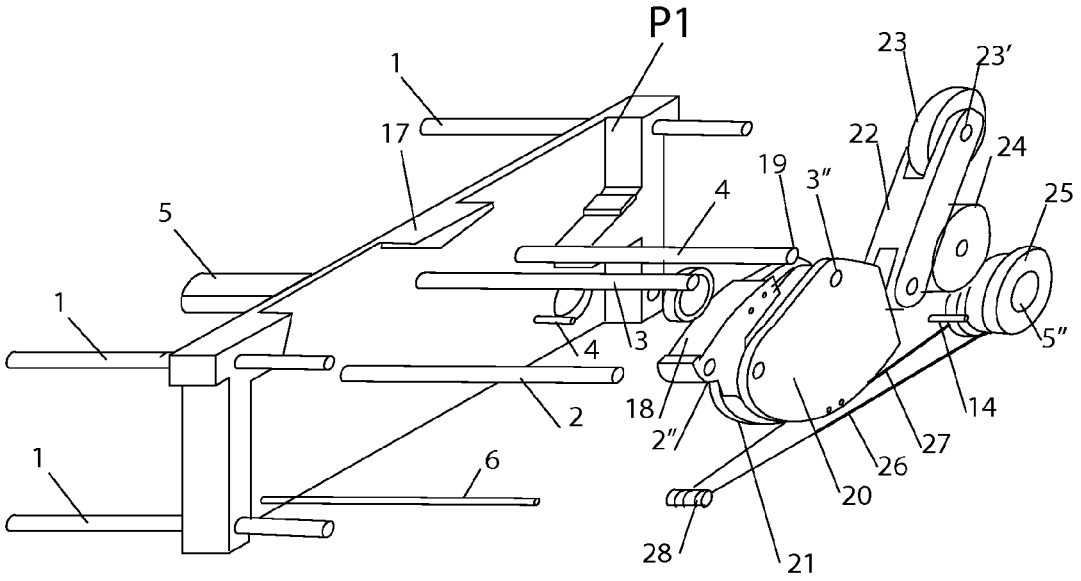
FIG. 6 schematically shows an even more enlarged perspective view in separate parts, in which further details of the embodiment shown in FIG. 1 are illustrated.
Figure 7:
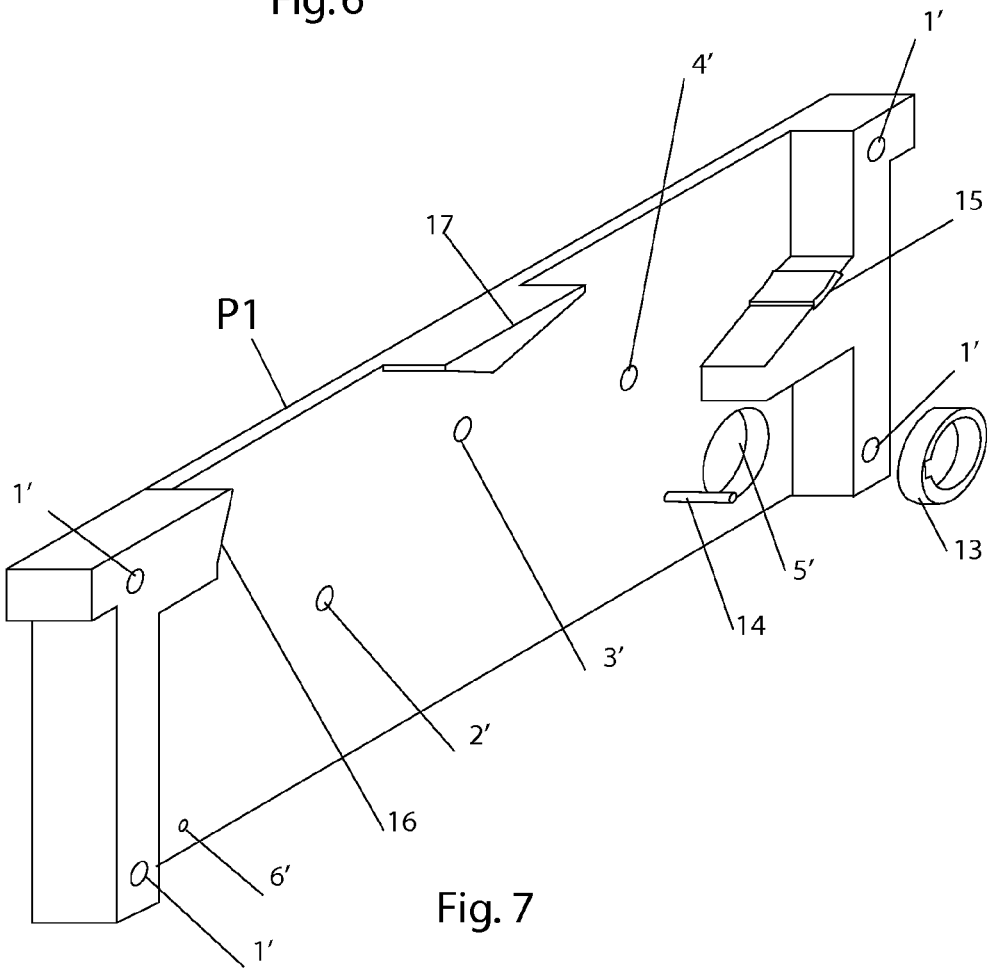
FIG. 7 schematically shows a perspective view in which one of the vertical walls forming the bank of mechanisms of the embodiment shown in FIG. 1.
Figure 8:
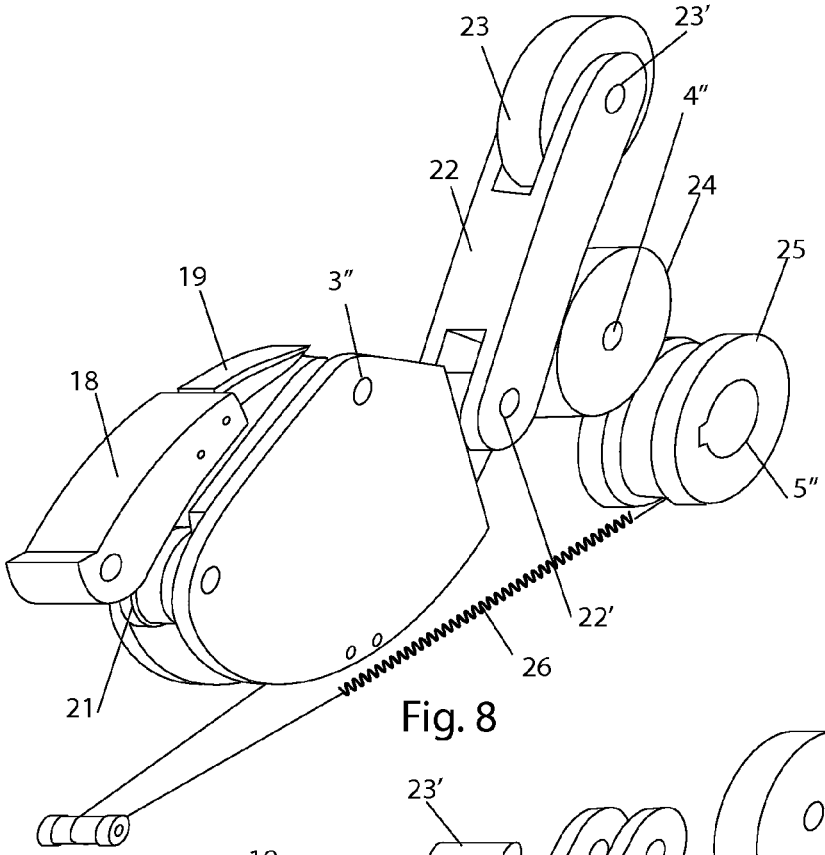
FIG. 8 schematically shows a perspective view of one of the mechanisms forming the bank of mechanisms of the embodiment shown in FIG. 1.
Figure 9:
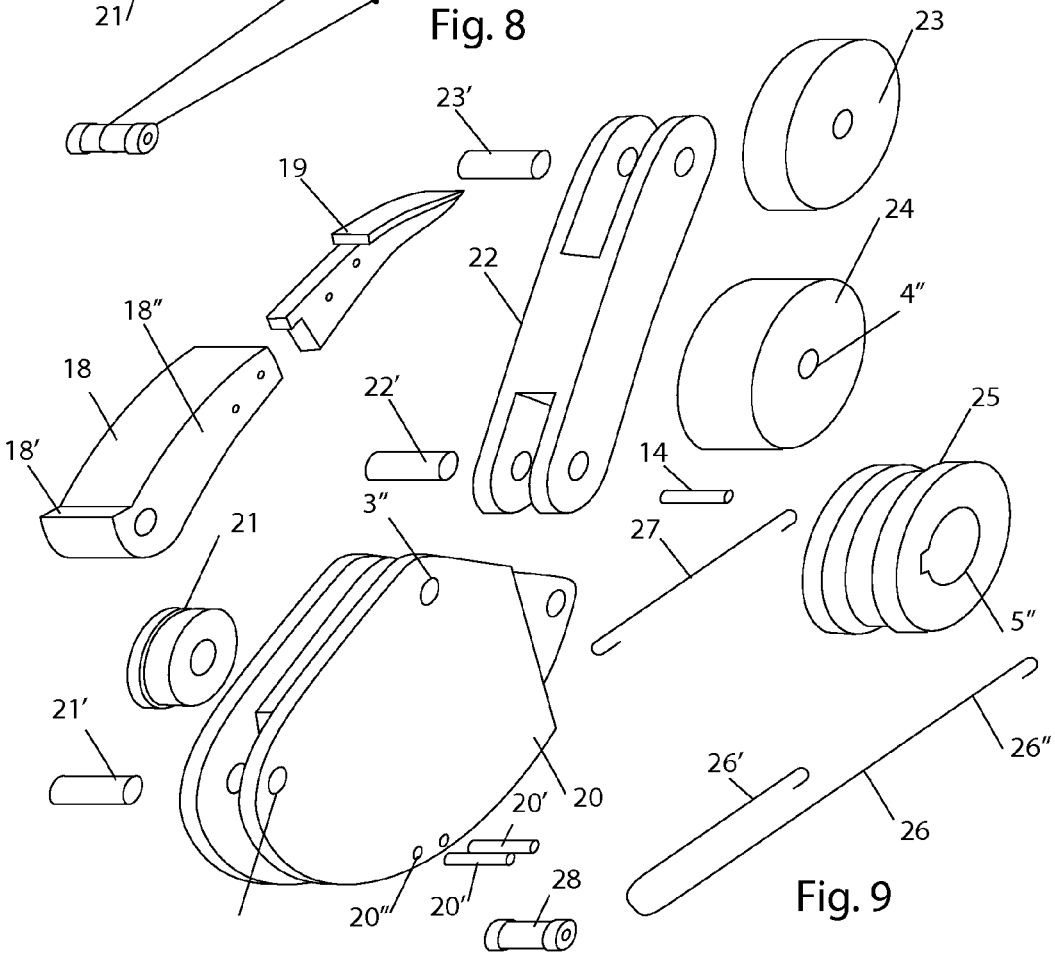
FIG. 9 schematically shows an exploded perspective view of one of the mechanisms forming the bank of mechanisms of the embodiment shown in FIG. 1.

Each mechanism M1 of the bank of mechanisms B1 according to the invention, depicted in FIGS. 1 to 15, and depicted in more detail in FIGS. 6, 8 and 9, consists of a mobile piece and lever set 20, 22, pivoted together on a shaft 22', the lever 22 having at its distal end from the mobile piece 20 a mobile roller 23 mounted on a shaft 23'; a jaw 18, 19, consisting of a body 18 and a removable spike 19; a mobile roller 21 mounted on a shaft 21', arranged on the mobile piece 20; a mobile roller 24; shafts 2, 3 and 4 common to the other mechanisms M1, mounted on through holes of the intermediate vertical walls P1 and end walls R1 and T1, in which are respectively mounted the jaw 18, 19, the mobile piece 20 and the roller 24; a stop 15, arranged on inner side of the intermediate vertical wall P1 near said roller 23, and which surface provided with a damping and noise reduction element, and serving as a stop for said roller 23; a stop 16, arranged on the inner side of the intermediate vertical wall P1 near said jaw 18, 19, and which surface serves as a stop to said jaw 18, 19; a triangular stop 17, arranged substantially in the middle and in the intermediate vertical wall P1 portion and serving as a stop for said mobile piece 20.

The bank of mechanisms B1 have associated with the end wall R1, a control device (see FIGS. 3, 4, 5) consisting of a bush 8 having a central and peripheral cogged recess; a manual driver 7, consisting of a screw, which acts on said bush 8 cogged recess and a motorized actuator 11, consisting of an engine that acts through a gear wheel 10 in a screw head 9, which in turn acts on said bush 8 cogged recess; common shafts 5 and 6, crossing said vertical walls R1, P1 and T1 through respective holes, on said common shaft 5 and joined to it by a indentation being mounted respectively the bushes 8, 13 and 25 and being mounted on said common shaft 6 of the resending pulleys 28; an elastic connecting rod 26, 26', 26" associated with each bush 25 of each mechanism M1, the elastic connecting rod 26, 26', 26" consisting of a helical spring (elastic portion) 26, a first rod portion (inelastic portion) 26' and a second rod portion (inelastic portion) 26" and being fixed by means of a rod portion 26" end to the bush 25 and being fixed by its another rod portion 26' end, passing through the resending pulley 28 to said mobile piece 20 in a shaft 20'; a spring 27 associated with said mobile piece 20 and which is fixed by its first end to said mobile piece 20 by another shaft 20', and by its another end to a shaft 14, fixed on the intermediate vertical wall P1.

Figure 10:
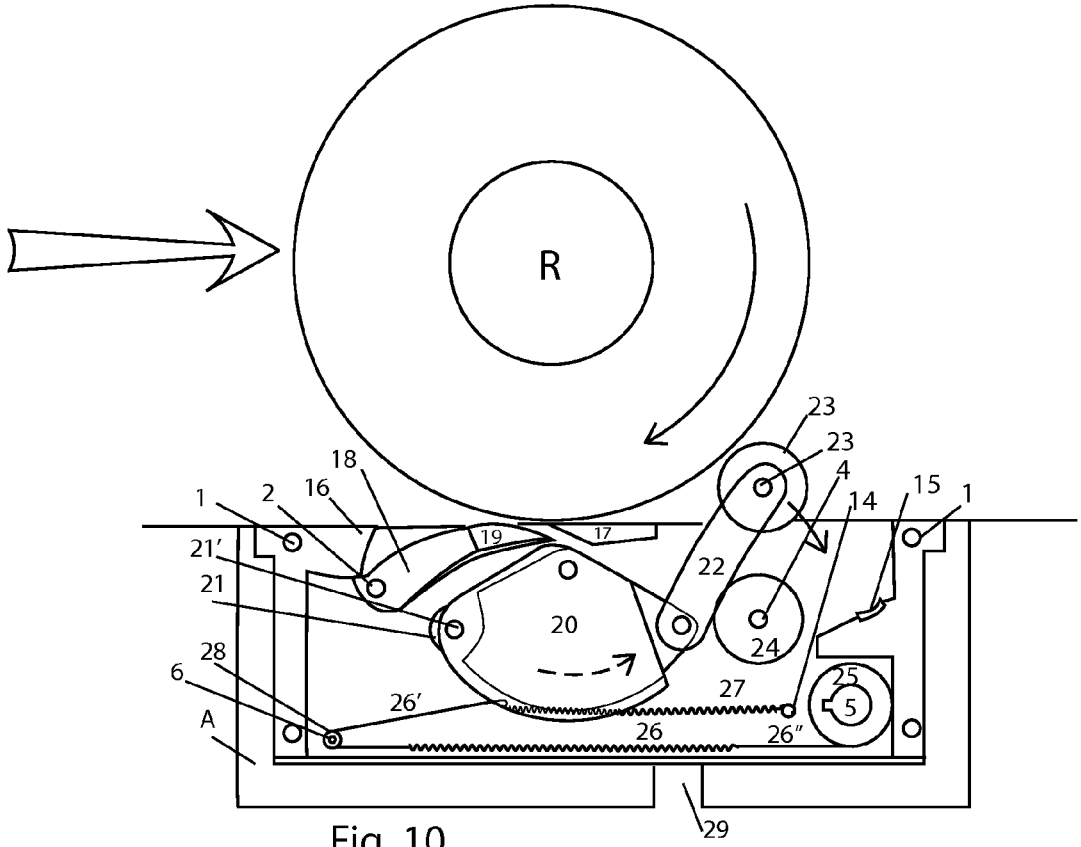
FIGS. 10 to 15 schematically show the operating mode of the embodiment shown in FIG. 1.
Figure 11:
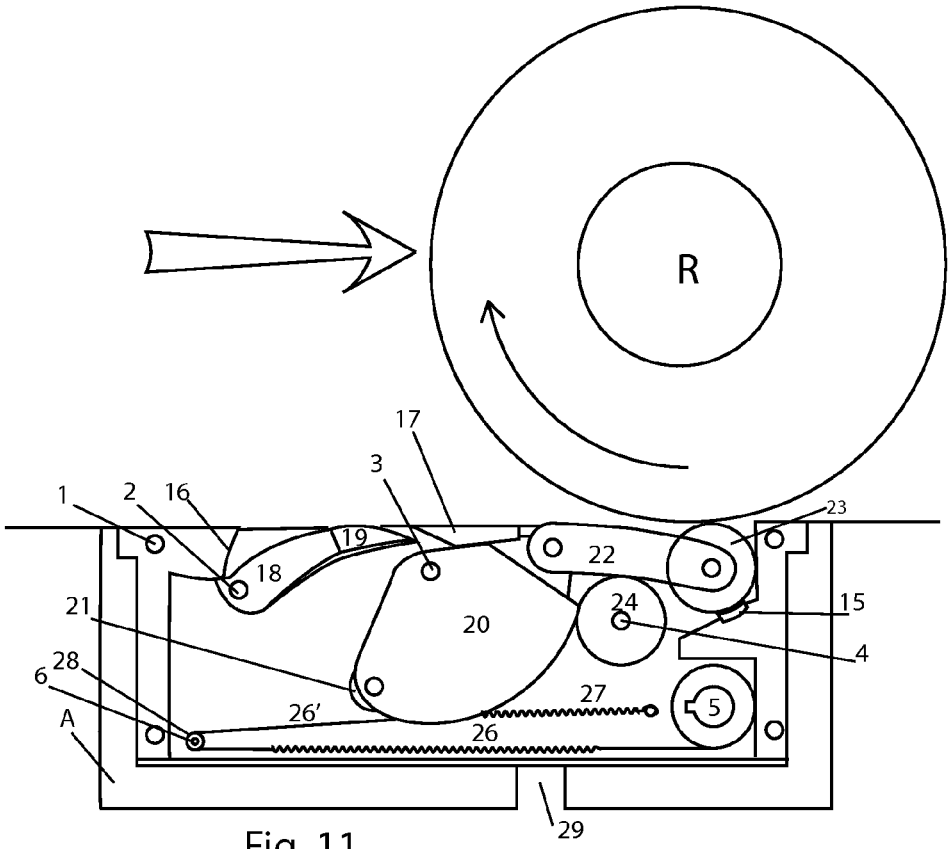
Figure 12:
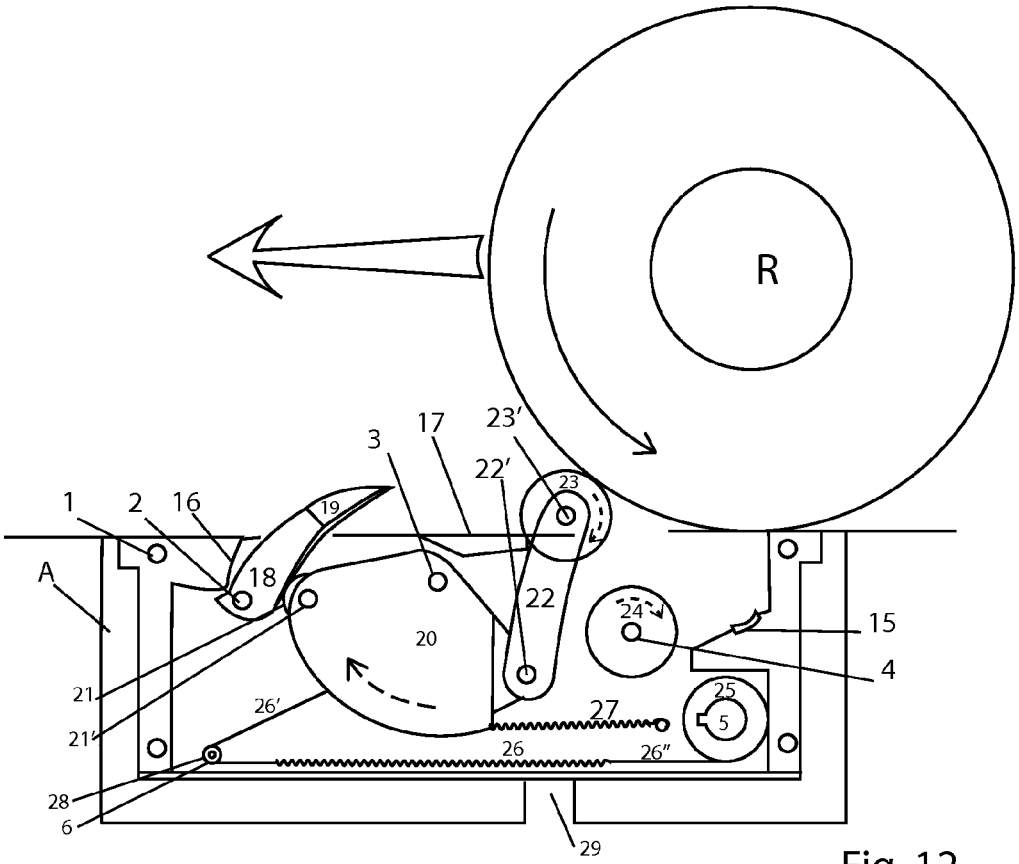
Figure 13:
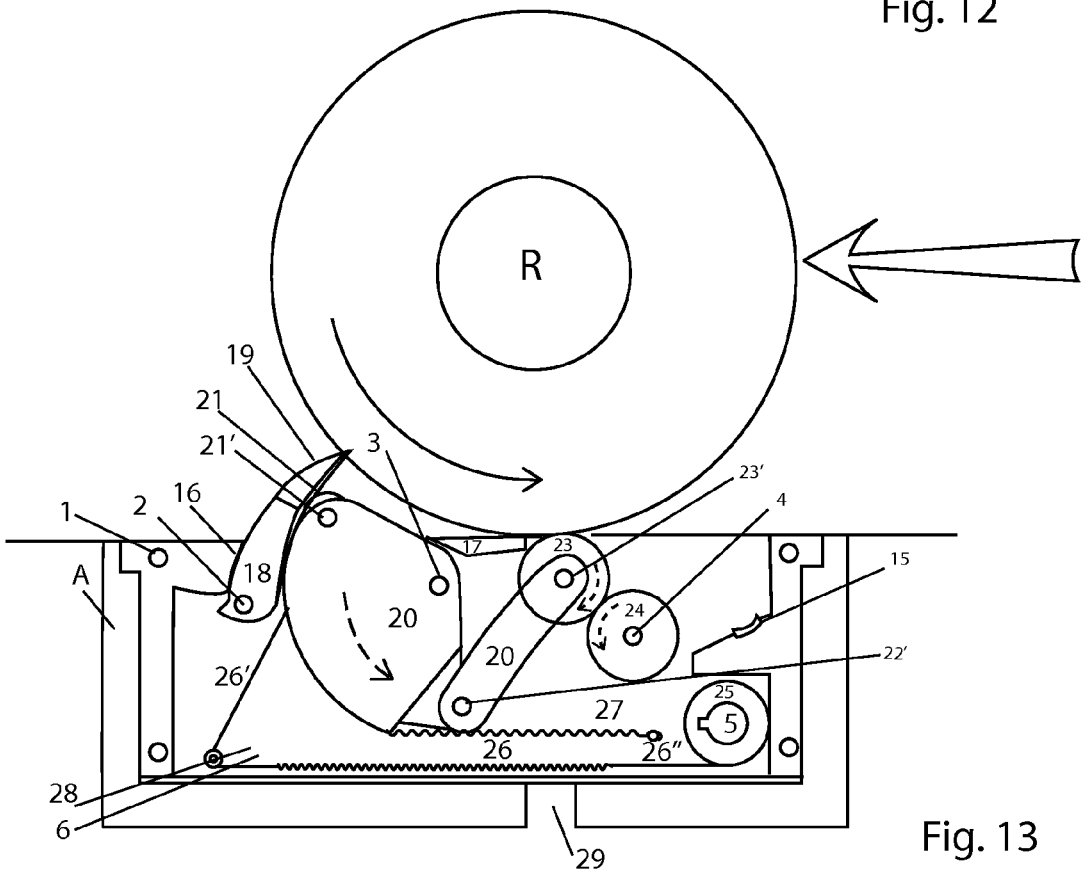

The bank of mechanisms B1 operates as follows:

- when there is no action on the device, each mechanism M1 stays in normal operating position, shown in FIG. 10, due to the gravity force and balance of springs 26 and 27 forces acting on the mobile piece 20;
- when a vehicle tyre R threads on the device in the appropriated or allowed traffic direction, it shifts at least one mobile roller 23, which moves into the bank of mechanisms B1 (see FIG. 10), leading the mobile roller 2 getting support on the stop 15 (see FIG. 11), the mechanism having no perceptible action on the tyre R;
- when one of the vehicle tyres R threads on the bank of mechanisms B1 in the wrong or forbidden travelling direction, it shifts at least one mobile roller 23, in the vehicle movement direction, shown in FIG. 12 and then in the downward direction. The mobile roller 23 moves the lever 22 in the downward direction in relation to the pavement; the tyre R keeping the movement, the mobile roller 23 slides on the mobile roller 24 and causes the piece 20 to rotate around the shaft 3, and the piece 20 going by means of roller 21 to push the jaw 18, 19, which rotates around its shaft 2, protruding from the bank of mechanisms B1, with support on the stop 16 surface, assuming a position in which is tyre R travelling on is punctured by the removable spike 19. The surface facing the top of the piece 20 adjacent to the tyre R acts as a barrier for it, in the position shown in FIG. 13, restraining the tyre R crossing the bank of mechanisms B1. After said wheel R has crossing the mechanism M1 is restored to the active position by the gravity force and springs 26 and 27 jointly acting on said mobile piece 20.

Figure 14:
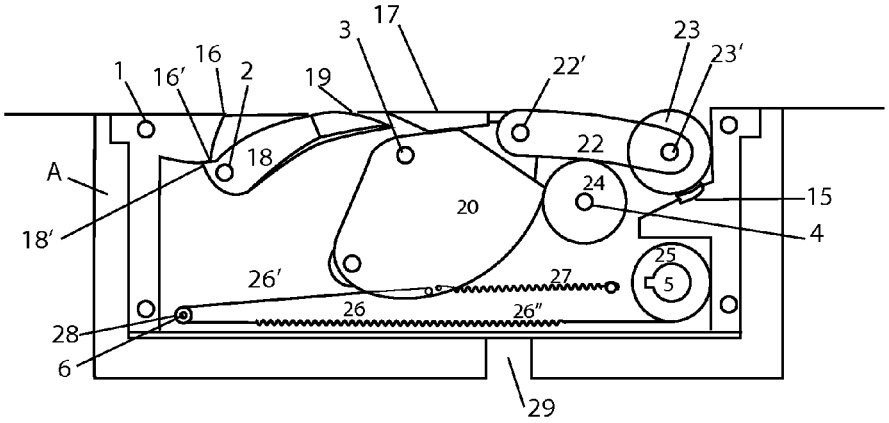
Figure 15:
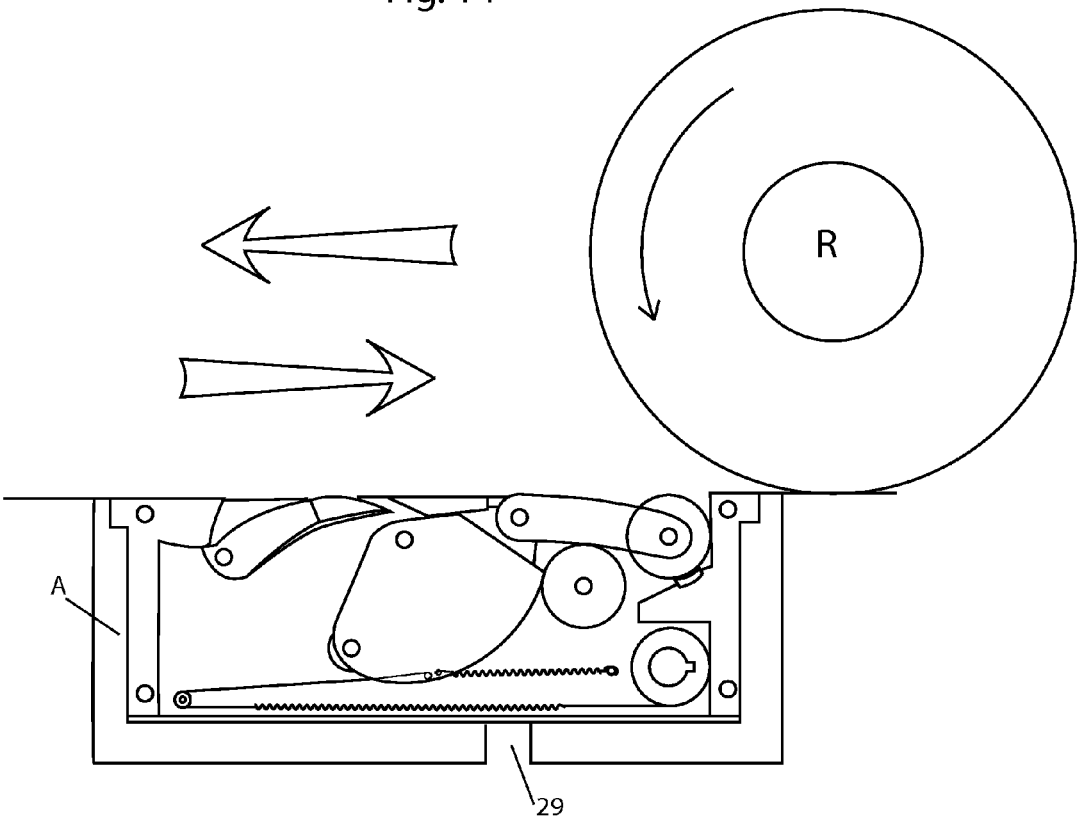

The control device operates as follows:

when the bank of mechanisms B1 is in normal operation position, the control device is active, i.e., keeps the balance of the springs 26 and 27 forces, as illustrated in FIG. 10;

when the bank of mechanisms B1 is in inactive operating position, depicted in FIG. 14, the control device is deactivated and the bush 25 rotates and does not exert any traction force on the elastic connecting rod 26, 26', 26", which in turn do not exert any driving force on the mobile piece 20. The mobile piece 20 is only subjected to the spring 27 driving force and rotates in the direction to inner side portion of the intermediate vertical wall P1 closest to the mobile roller 23, in order to cause the displacement of the roller 23 down, so it goes to rest on stop 15, on other words causes the withdrawal of the mobile roller 23 into the bank of mechanisms B1, bellow the road pavement plan, allowing traffic in both directions, with the mechanism imperceptible.

Each mechanism M2 of the bank of mechanisms B2 according to the invention, depicted in FIGS. 16 to 25, is depicted in more detail in FIGS. 18 to 21, consists of a mobile piece 20 having a removable spike 19; a mobile roller 23 mounted on a shaft 23' in said mobile piece 20; a shaft 3, common to the other mechanisms M2 housed in the other cells of the bank of mechanisms 82, which supports said mobile piece 20; a stop 15, arranged on the intermediate vertical wall P2 inner side near said removable spike 19, and which surface, provided with a damping and noise reduction element, serves as the stop to said roller 23; and a stop 16, arranged on inner side of the intermediate vertical wall P1 away from said removable spike 19, and which surface acts as a stop to said roller 23.

Figure 24:
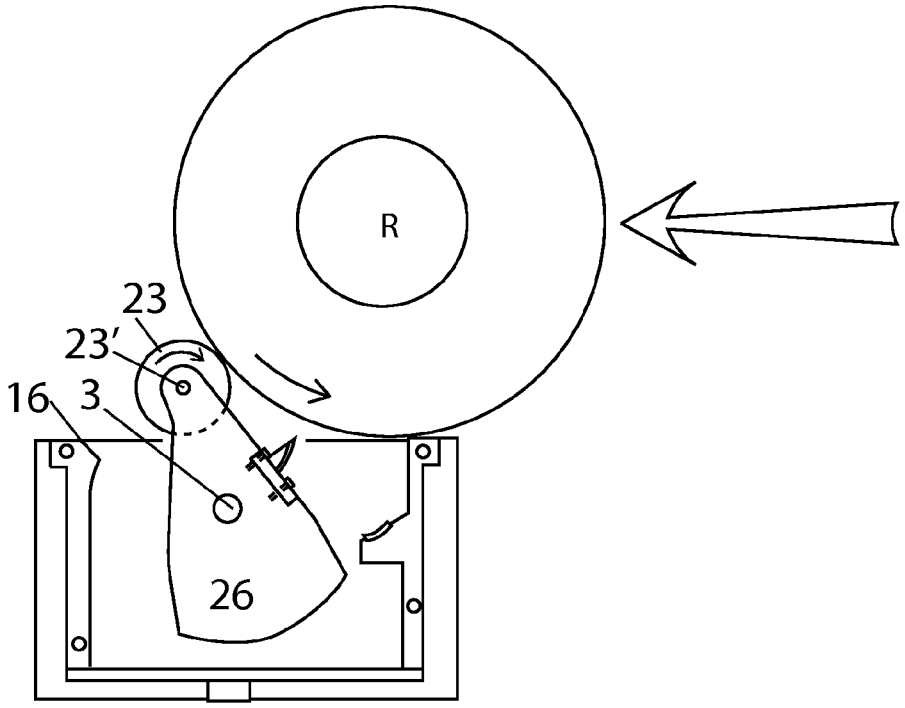
Figure 25:
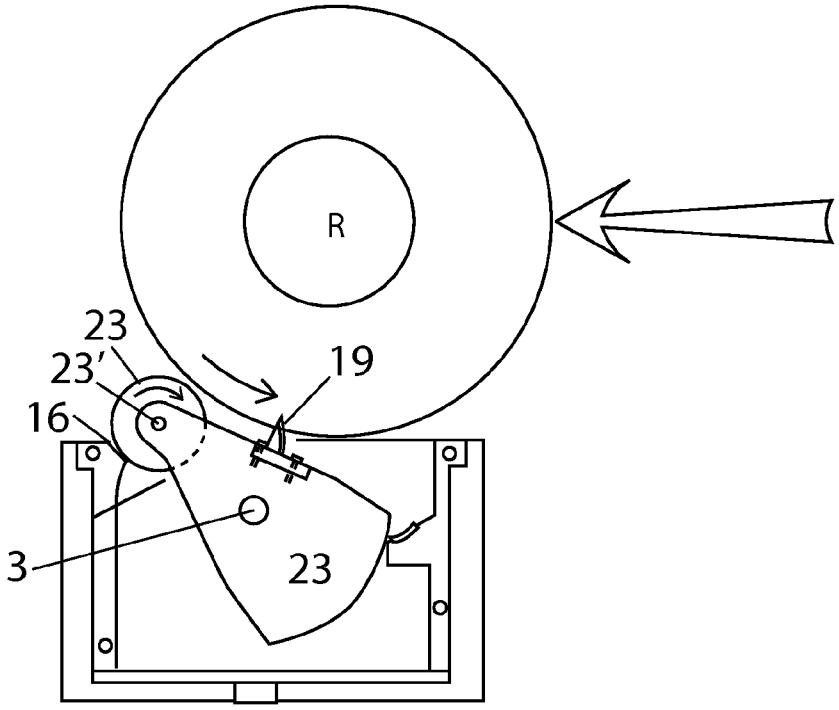
Figure 26:
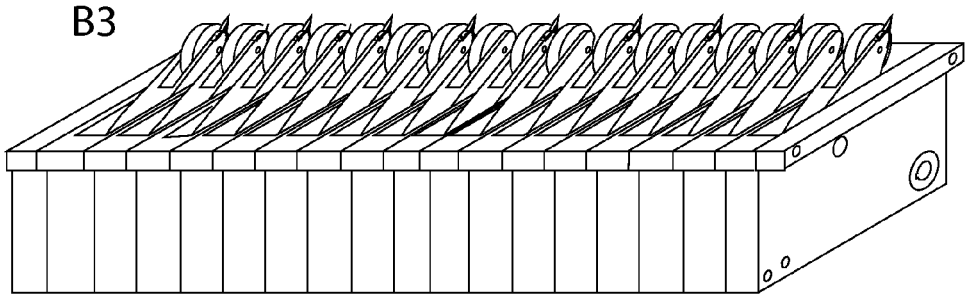
FIG. 26 schematically shows a bank of mechanisms perspective view according to a third device embodiment according to the invention.
Figure 27:
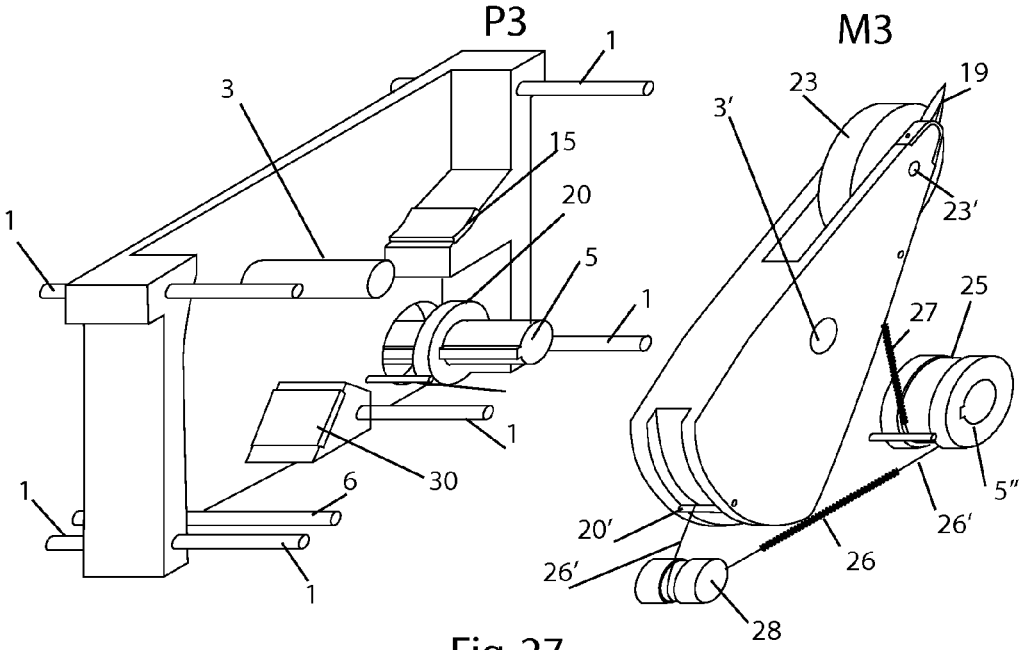
FIG. 27 schematically shows an enlarged perspective view in separate parts, in which details of the embodiment shown in FIG. 26 are illustrated.
Figure 28:
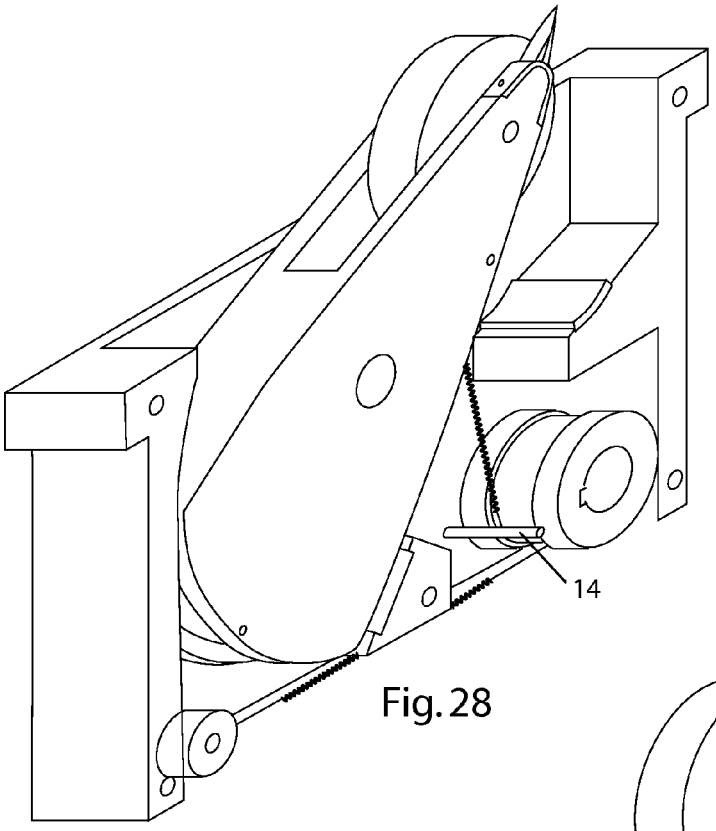
FIG. 28 schematically shows a mechanism mobile piece perspective view of the embodiment shown in FIG. 26, mounted on the respective intermediate vertical wall.
Figure 29:
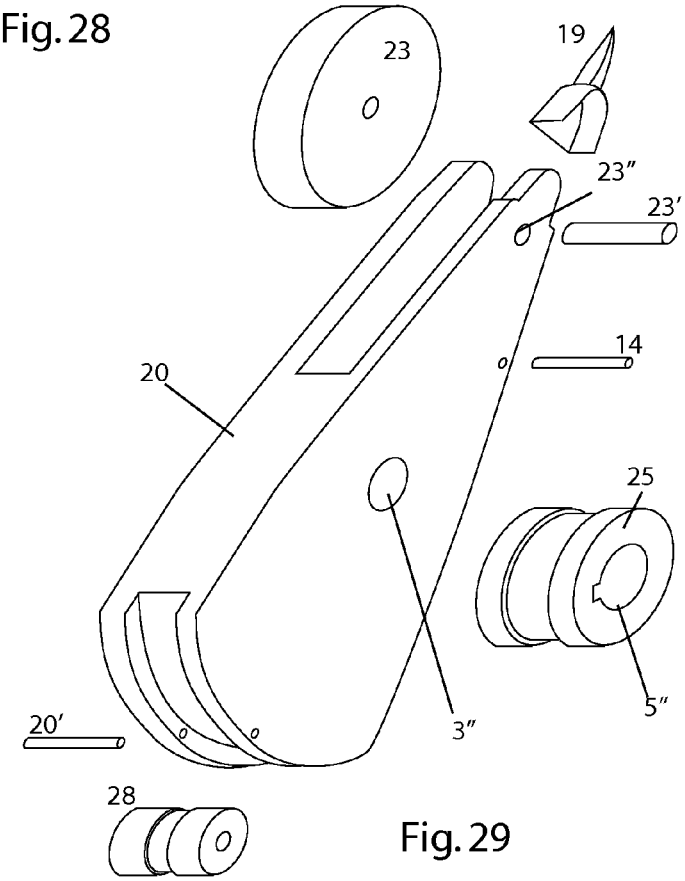
FIG. 29 schematically shows an enlarged perspective view in separate parts of the mechanism mobile piece of the embodiment shown in FIG. 26.

The bank of mechanisms B2 operates as follows:

when there is no action on the bank of mechanisms B2, each mechanism M2 stays in the normal operating position by the gravity force action (see FIGS. 16, 17, 18 and 19);

when a vehicle tyre R threads on the device in the appropriated or allowed travelling direction, it shifts at least one mobile roller 23, which moves in the direction indicated by the arrow (see FIG. 22), the mobile roller getting support (see FIG. 23) on stop 15, the mechanism not taking any perceptible action on the tyre R;

when a vehicle tyre R threads on the bank of mechanisms B2 in the wrong or forbidden travelling direction it shifts at least one mobile roller 23 in the direction shown in FIG. 24, the mobile roller getting support on stop 16, arranged on the side of the intermediate vertical wall P2 opposite to the removable spike 19 (see FIG. 25) and the removable spike 19 punctures the tyre R. The mobile roller 23 forms a slippery barrier to the tyre R which together with the removable spike 19, causes the tyre R tearing, and therefore the vehicle immobilization.

Each mechanism M3 of the bank of mechanisms B3 according to the invention, depicted in FIGS. 26 to 35, and in more detail in FIGS. 27 to 31, consists of a mobile piece 20 having a removable spike 19; a mobile roller 23 mounted on a shaft 23' in said mobile piece 20; a shaft 3 common to the other mechanisms M3 housed in the other cells of the bank of mechanisms B3, which supports said mobile piece 20; a stop 15 arranged on the inner side of the intermediate vertical wall P2 near said removable spike 19, and which surface provided with a damping and noise reduction element, acts as a stop to said roller 23; a stop 30, arranged bellow the intermediate vertical wall P3, away from said mobile spike 19, and which surface, provided with a damping and noise reduction element, acts as a stop to said mobile piece 20.

The bank of mechanisms B3 presents, associated with the end wall R3 a control device consisting of a bush 8, having peripherally and centrally a cogged recess; a manual driver 7, consisting of a screw acting on said bush 8 cogged recess and a motorized actuator 11, consisting of one engine that operates a head 9 of a screw through a gear wheel 10, the screw in turn acting on said bush 8 cogged recess; common shafts 5 and 6, crossing said vertical walls R3, P3 and T3 through respective holes, on said common shaft 5 and joined to it by a indentation being mounted respectively the bushes 8, 13 and 25 and the resending pulleys 28 being mounted on said common shaft 6; an elastic connecting rod 26, 26', 26" associated with each bush 25 of each mechanism M3, the elastic connecting rod 26, 26', 26" consisting of a helical spring (elastic part) 26, a first rod portion (inelastic part) 26' and a second road portion (inelastic part) 26" and being fixed by means of a end of the rod portion 26" to the bush 25 and being fixed by its another end of the rod portion 26', crossing the resending bush 28 to said mobile piece 20 in a shaft 20; a spring 27 associated with said mobile piece 20 and which is fixed by its first end to said mobile piece 20 by another shaft 20', and by its another end to a shaft 14, fixed on the intermediate vertical wall P3.

Figure 30:
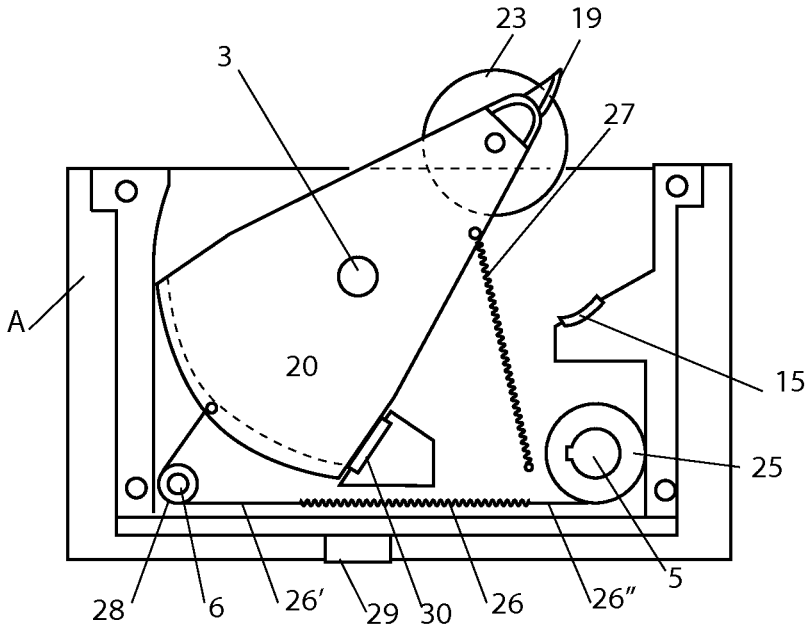
FIGS. 30 and 31 schematically show a side elevation view of a mechanism and respective intermediate vertical wall of the embodiment shown in FIG. 26, respectively in an active position and in an inactive position.
Figure 31:
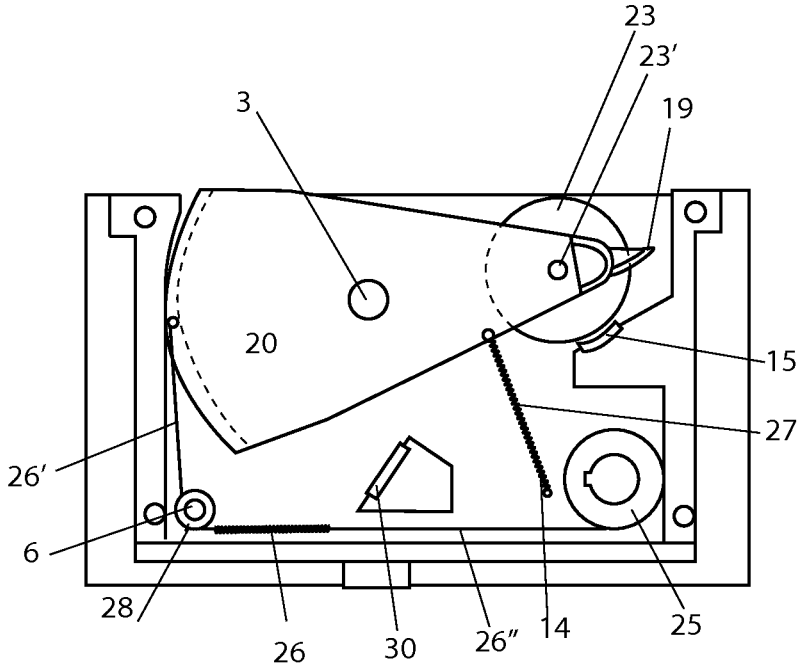
Figure 32:
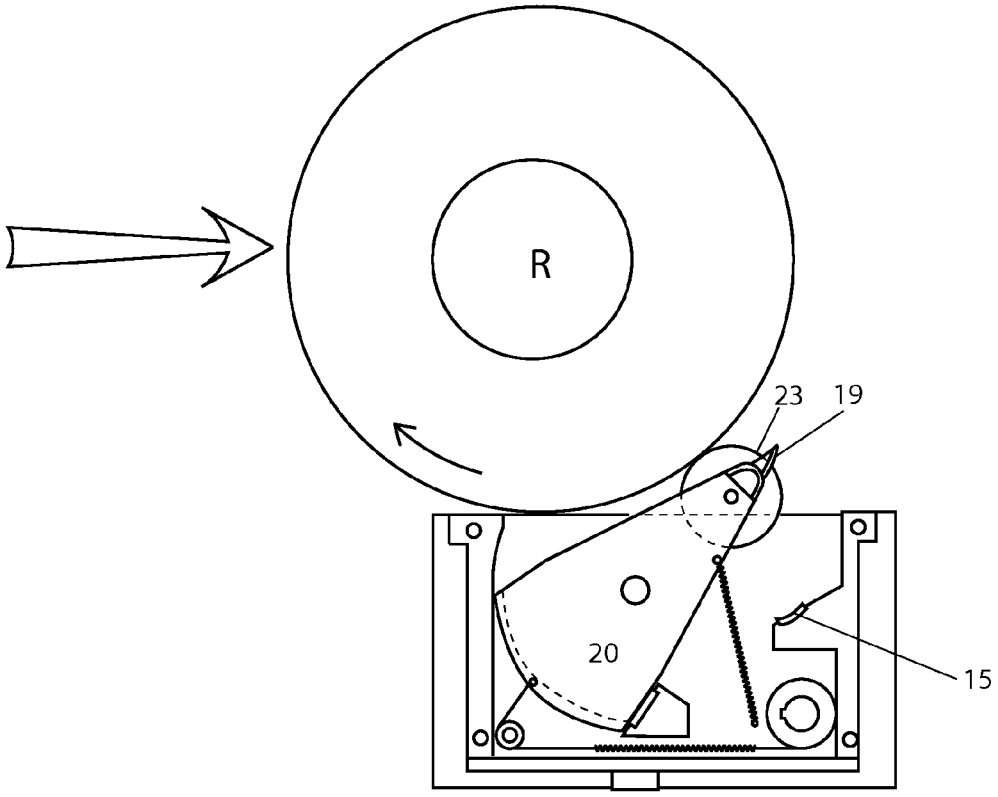
FIGS. 32 to 35 schematically show the operating mode of the embodiment shown in FIG. 26.
Figure 33:
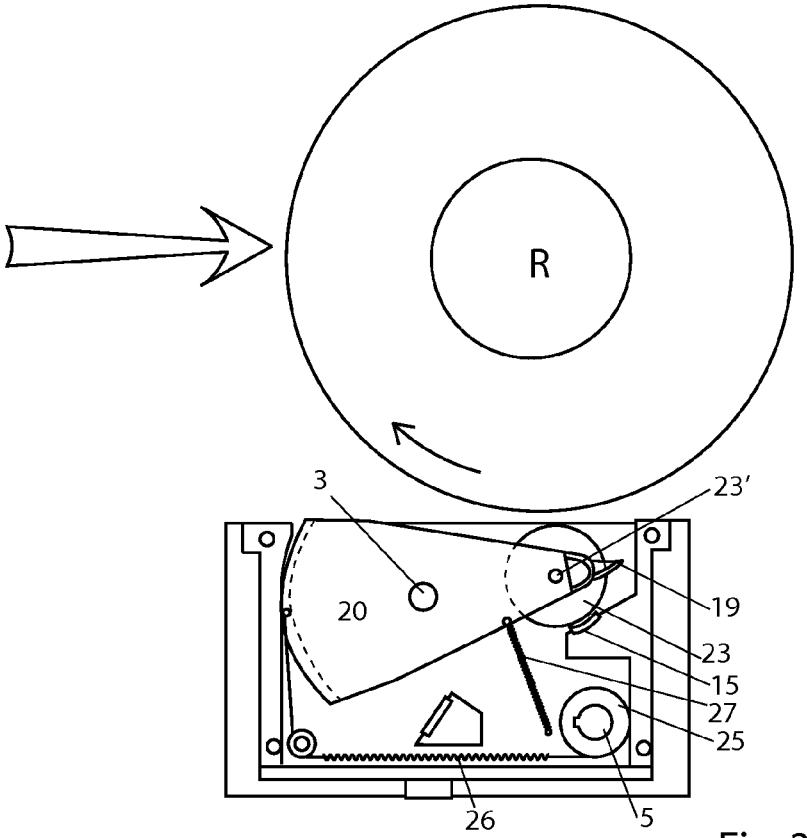
Figure 34:
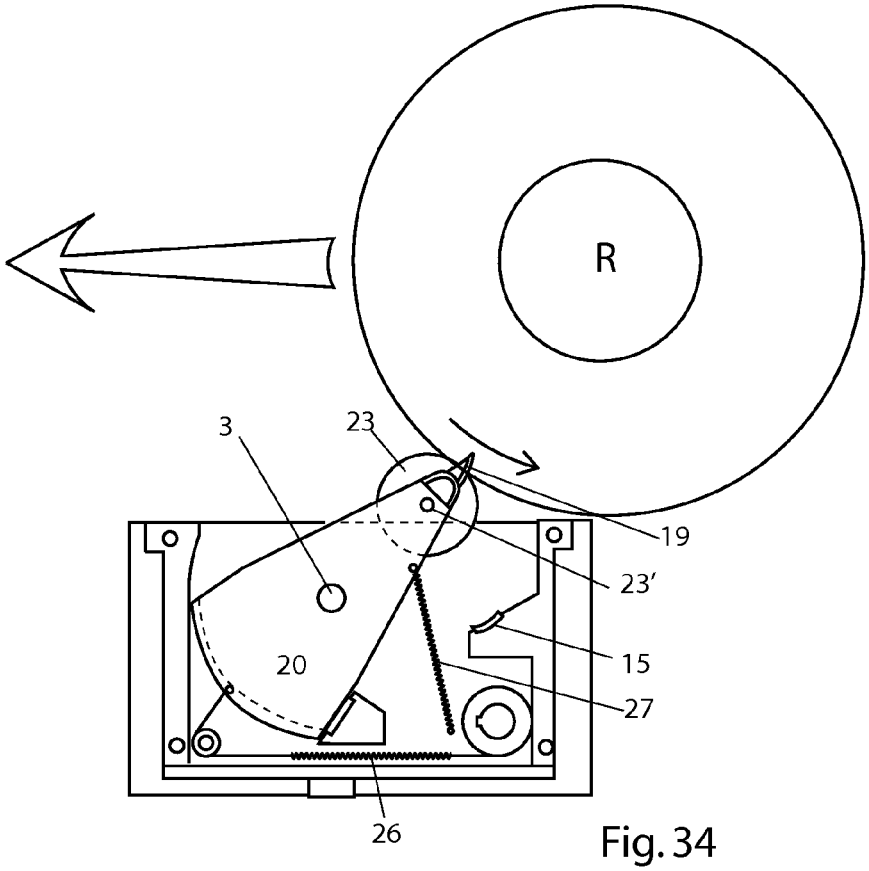
Figure 35:
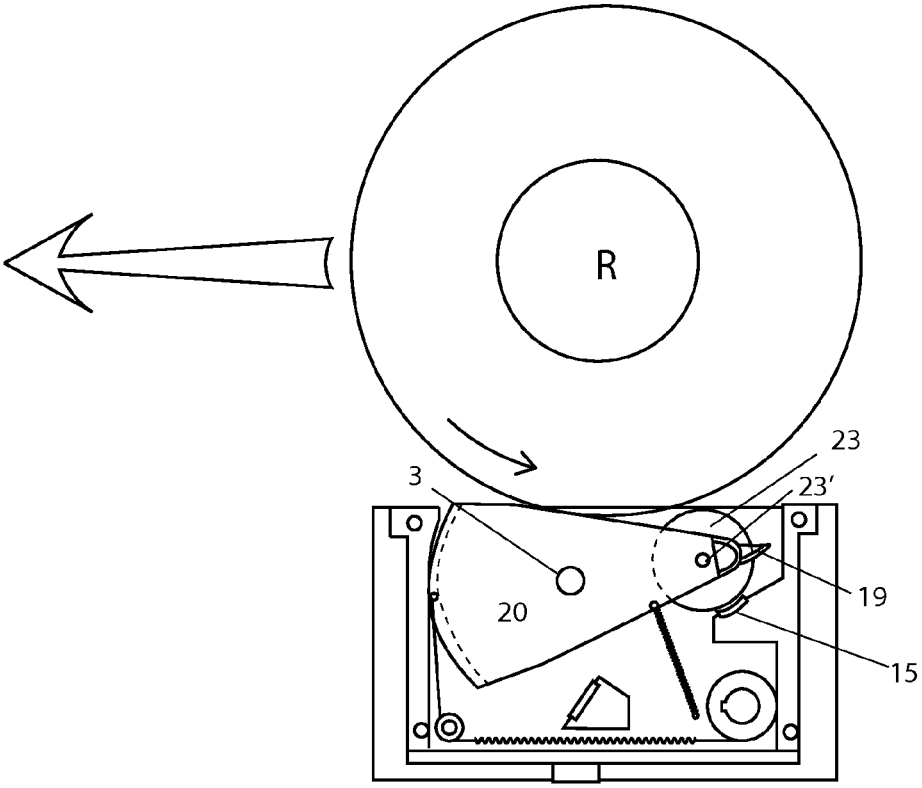
Figure 36:
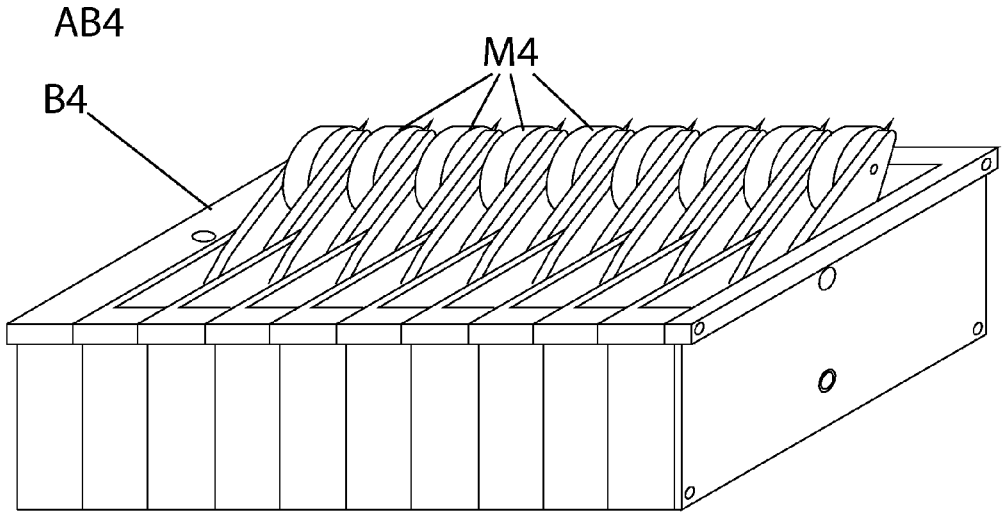
FIG. 36 schematically shows a perspective view of the bank of mechanisms according to a fourth device embodiment according to the invention.
Figure 37:
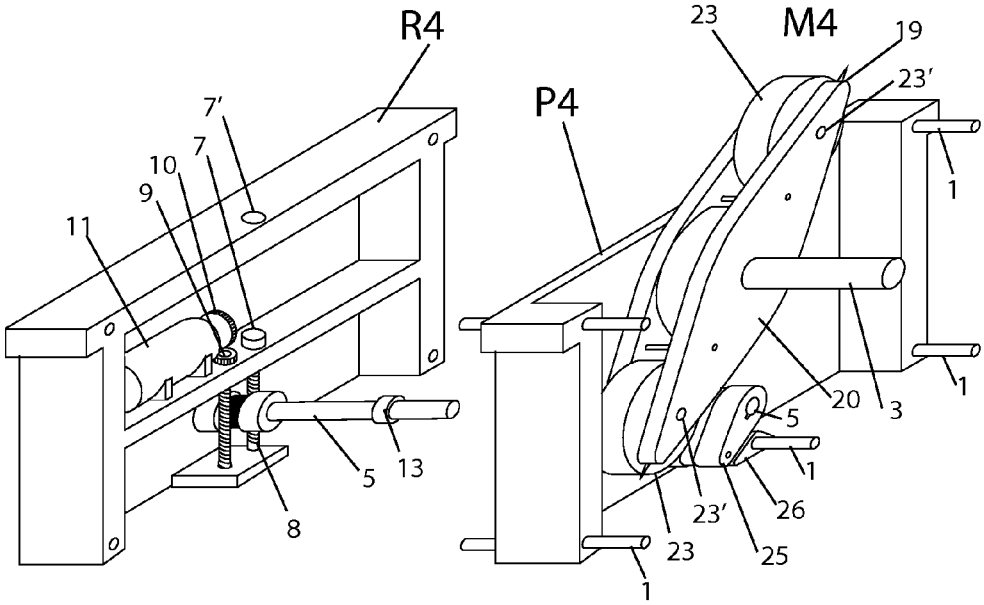
FIG. 37 schematically shows an enlarged perspective view in separate parts, in which details of the embodiment shown in FIG. 36 are illustrated.
Figure 38:
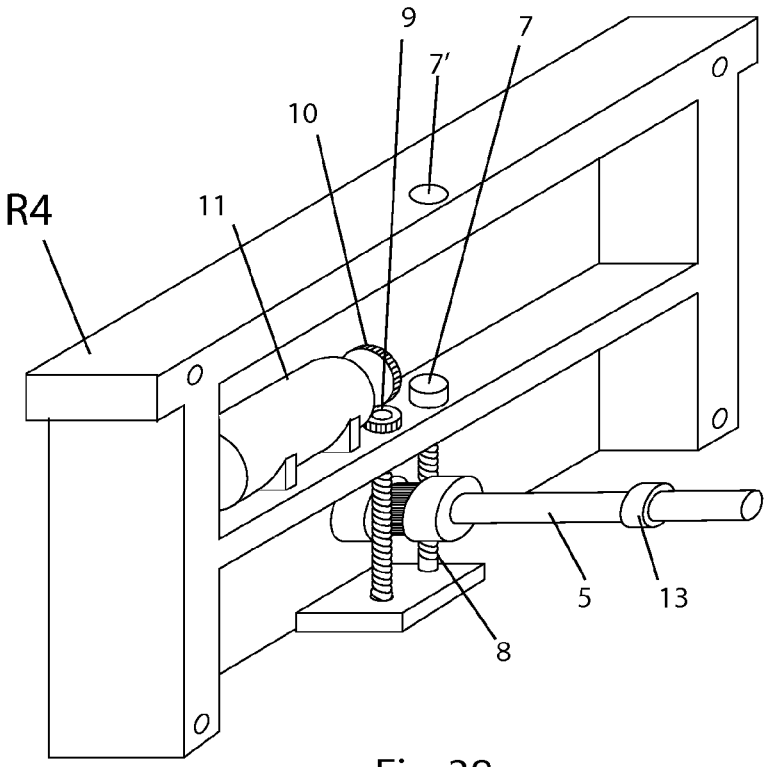
FIG. 38 schematically shows a perspective view of the control device of the mechanisms of the embodiment shown in FIG. 36, mounted on an end vertical wall.
Figure 39:
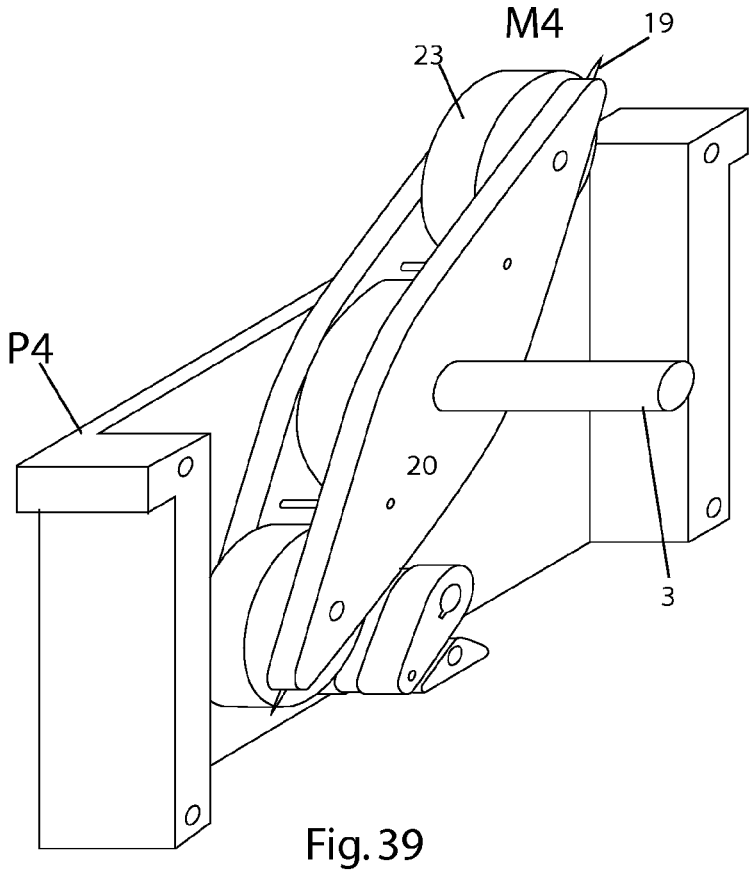
FIG. 39 schematically shows a perspective view of the mechanism mobile piece the embodiment shown in FIG. 36, mounted on the respective intermediate vertical wall.
Figure 40:
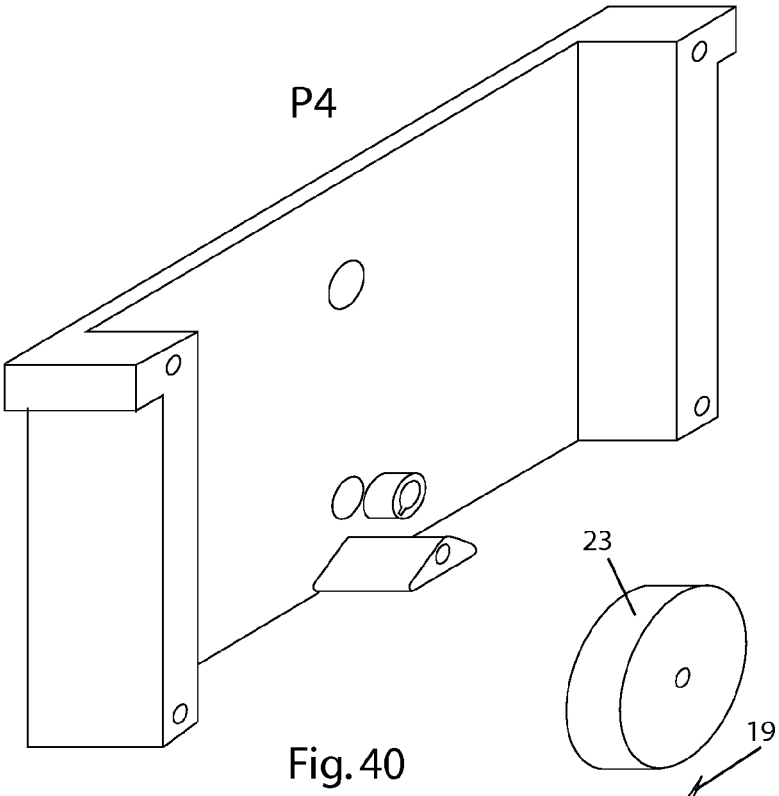
FIG. 40 schematically shows an intermediate vertical wall perspective view of the bank of mechanisms of the embodiment shown in FIG. 36.
Figure 41:
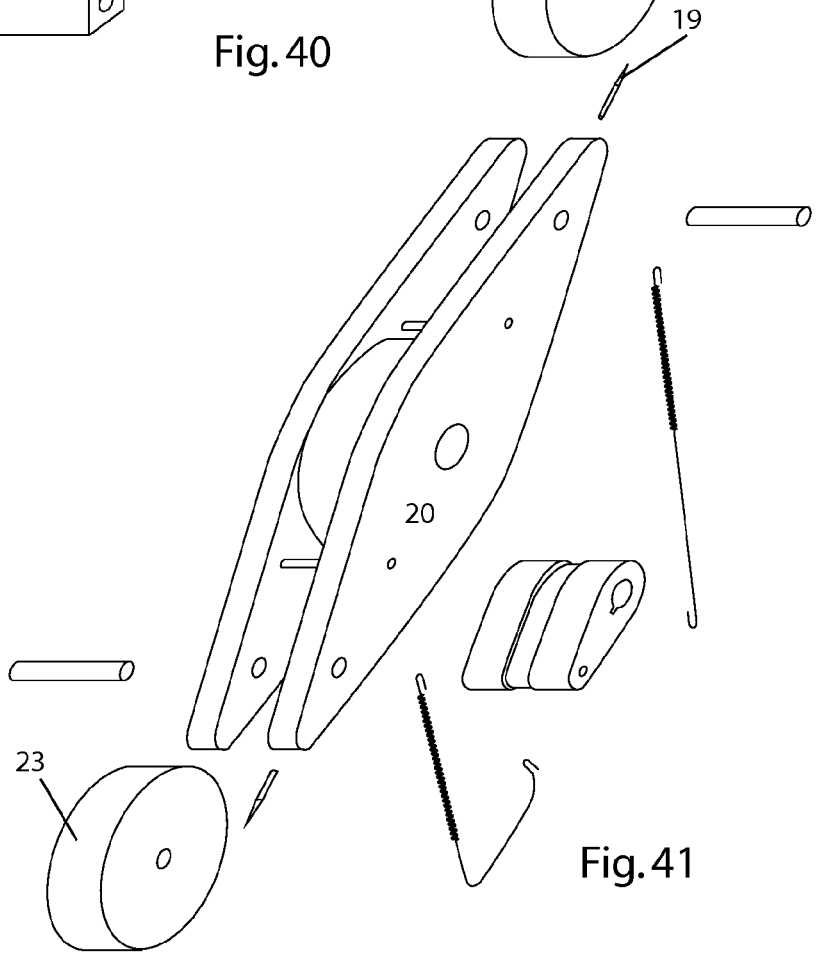
FIG. 41 schematically shows an exploded and expanded perspective view of the mechanism mobile piece of the embodiment shown in FIG. 36.

The bank of mechanisms B3 operates as follows:

when there is no action on the bank of mechanisms B3, each mechanism M3 stays the normal operating position, shown in FIG. 30, due to the gravity force and balance of springs 26 and 27 forces acting on the mobile piece 20;

when a vehicle tyre R threads on the device in the appropriated or allowed travelling direction, shifts at least one mobile roller 23, which moves in the direction indicated by the arrow in FIG. 32, the mobile roller getting support (see FIG. 33) on the stop 15, the mechanism not taking any perceptible action on the tyre R;

when a vehicle tyre R threads on the bank of mechanisms B2 in the wrong or forbidden travelling direction (see FIG. 34), it collides at least against one removable spike 19, penetrating the tyre R, getting support then on a mobile roller 23. The mobile roller 23 forms a slippery barrier to the tyre R that together with the removable spike 19 causes the tyre R tearing and therefore the vehicle immobilization.

The control device operates as described in relation to the bank of mechanisms B1.

Each mechanism M4 of the bank of mechanisms B4 according to the invention, depicted in FIGS. 36 to 48, is a reversible mechanism, i.e. it allows the selection of the travelling direction. Each mechanism M4, depicted in more detail in FIGS. 37 to 41, consists of a mobile piece 20 in lozenge shape, having two acute ends, each having a removable spike 19; two mobile rollers 23, mounted on shafts 23', in said mobile piece 20; a shaft 3 common to the other mechanisms M4, housed in the other cells of the bank of mechanisms B4, supporting said mobile piece 20; a eccentric drive bush 25, having a resending roller 28 mounted on a central slot of its eccentric portion; a triangular stop piece 26, arranged central and bellow the intermediate vertical wall P4, serving as a stop to a eccentric bush 25 and to a control drive, consisting of a bush 8, having peripherally and centrally a cogged recess; a manual driver 7, consisting of a screw, acting in said bush 8 cogged recess and a motorized actuator 11, consisting of one engine that operates a head 9 of a screw through a gear wheel 10, the screw in turn acting on said bush 8 cogged recess; the common shaft 5 crossing said vertical walls R4, P4 and T4 through respective holes, on said common shaft 5 and joined to it by a indentation being mounted respectively the bushes 7, 13 and 25; two elastic connecting rods 26, 26' associated to each bush 25, of each mechanism M4, each elastic connecting rod 26, 26' consisting of a helical spring (elastic portion) 26, being fixed by its free end to said mobile piece 20.

Figure 42:
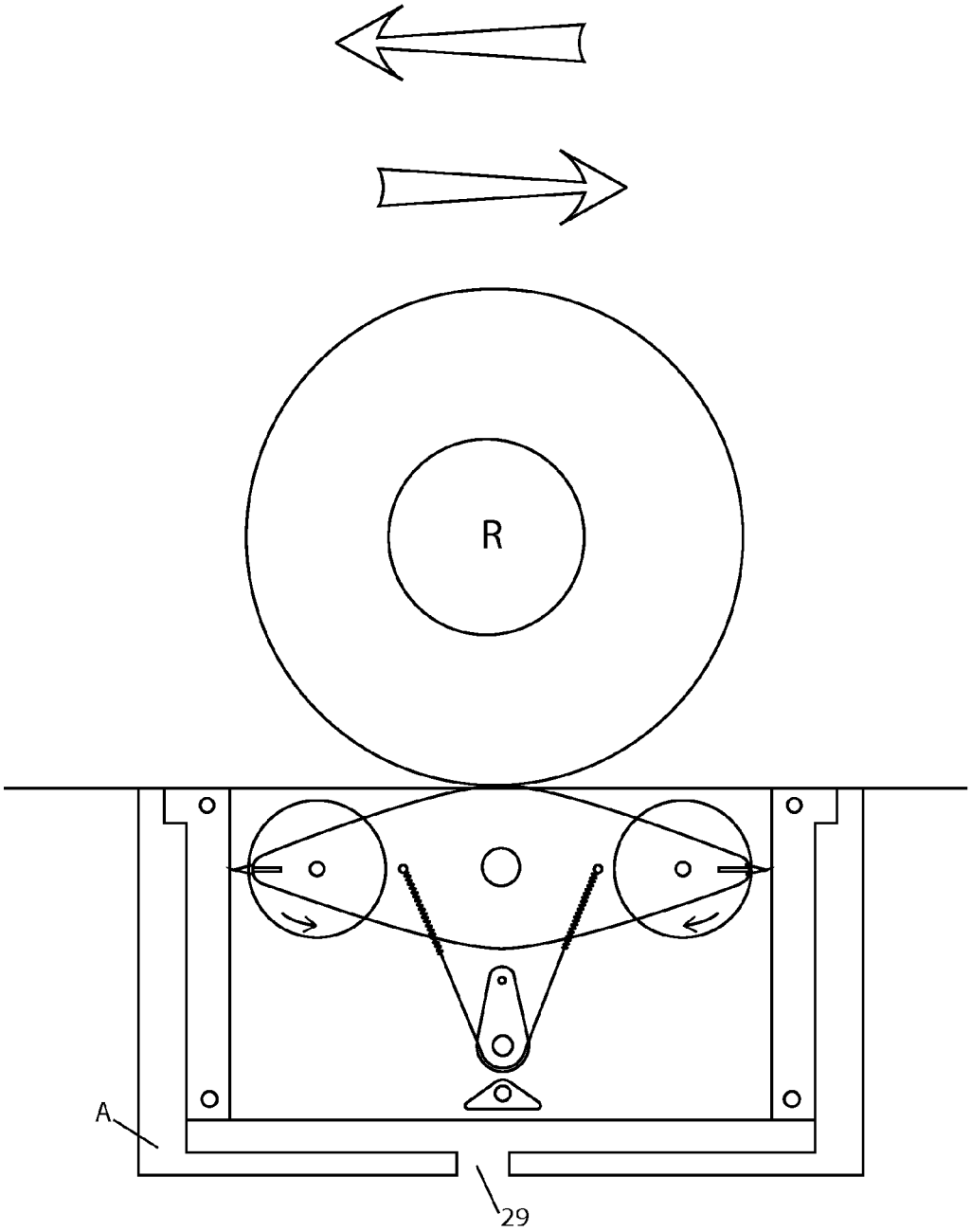
FIGS. 42 to 48 schematically show the operating mode of the embodiment shown in FIG. 36.
Figure 43:
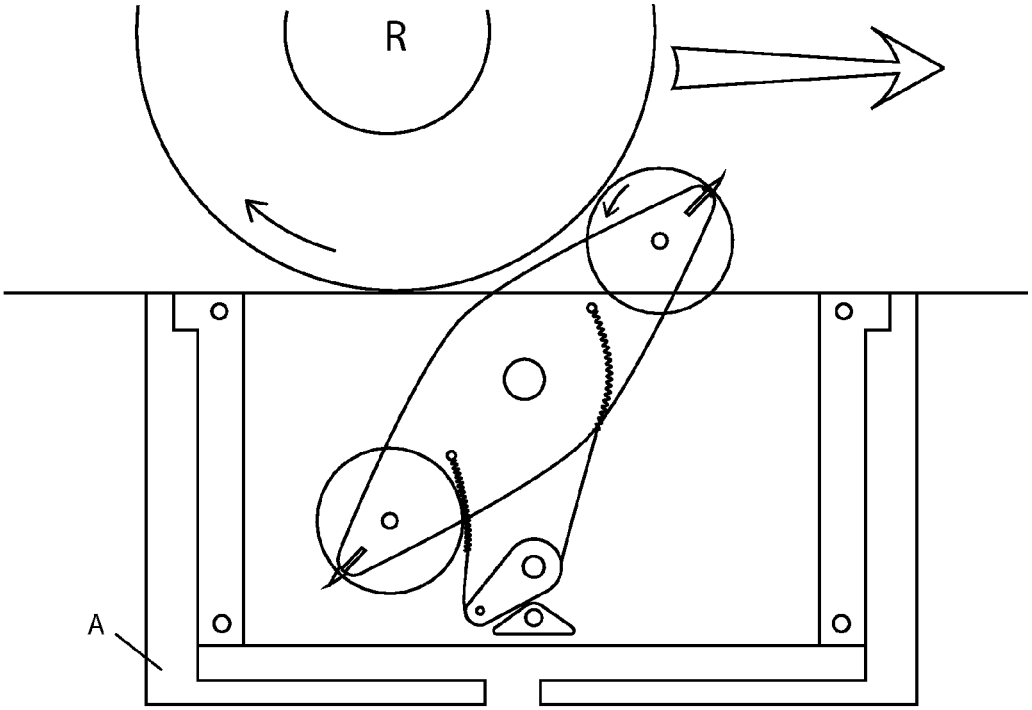
Figure 44:
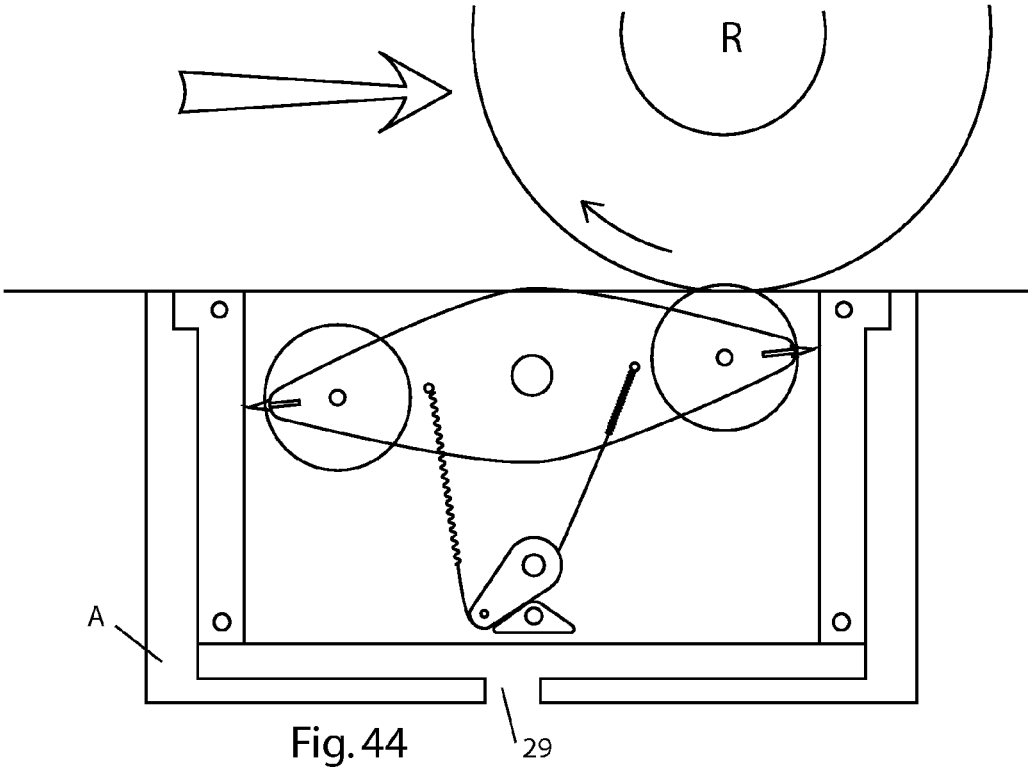
Figure 45:
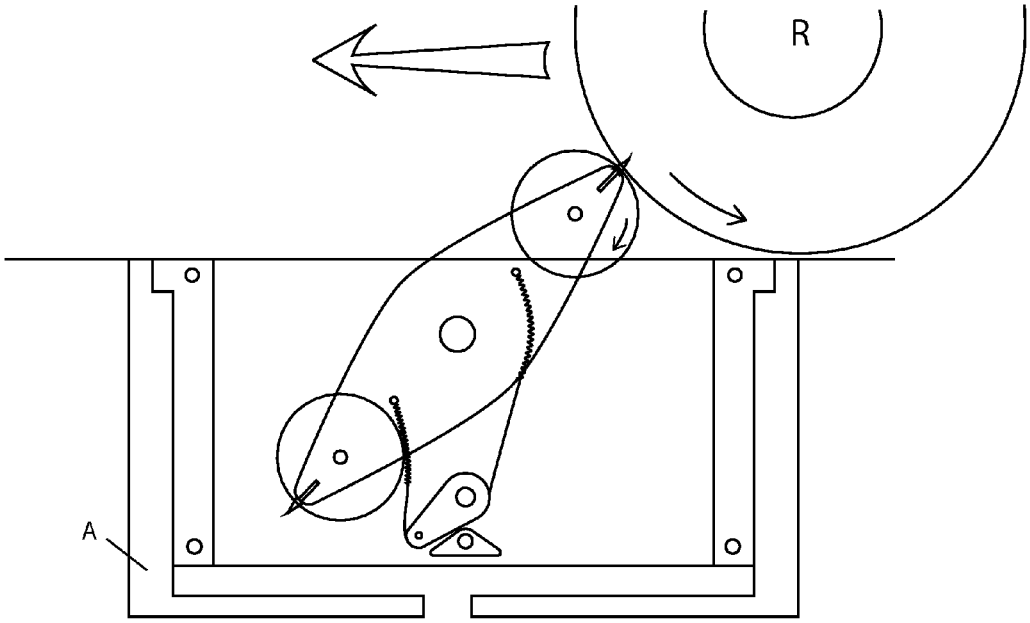
Figure 46:
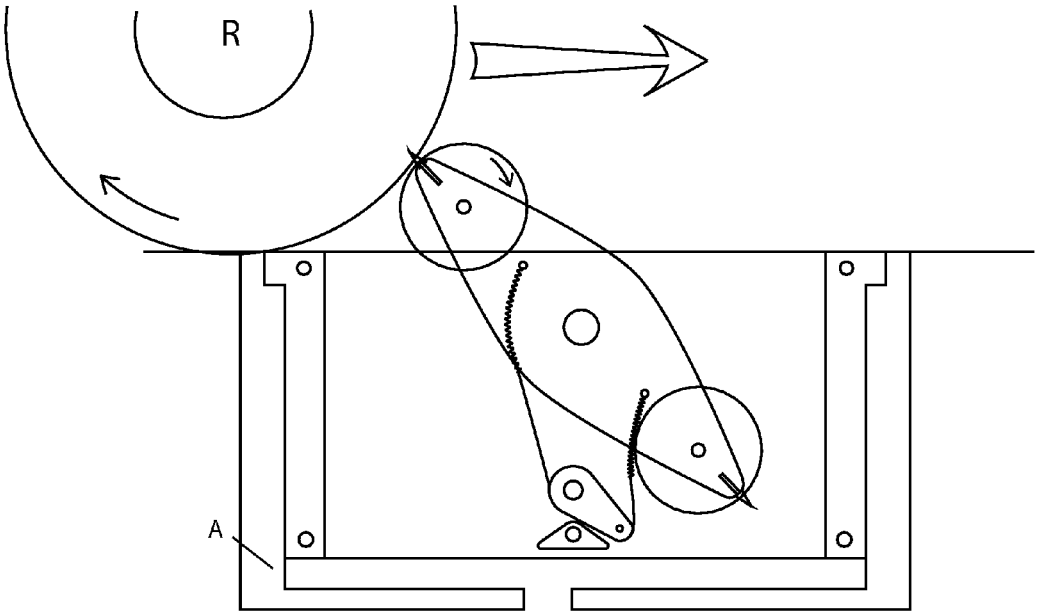
Figure 47:
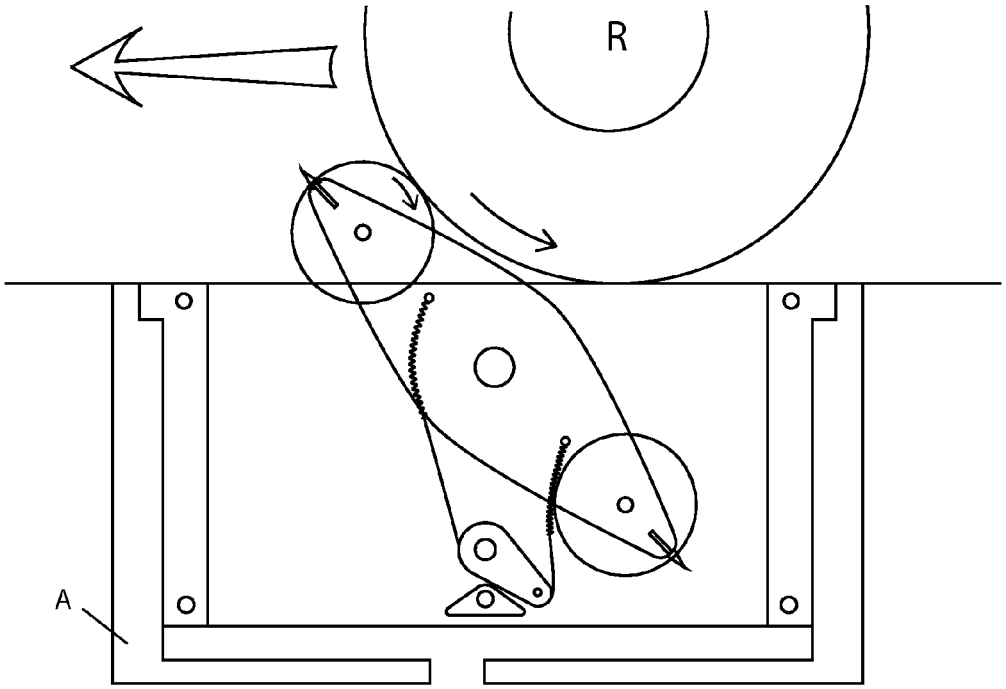
Figure 48:
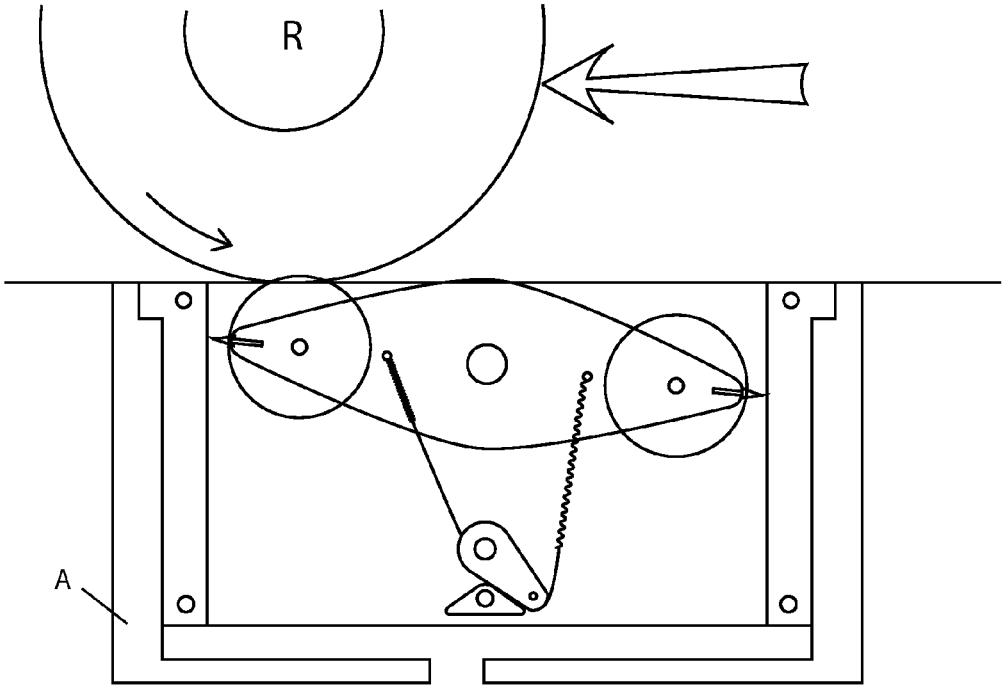
Figure 49:
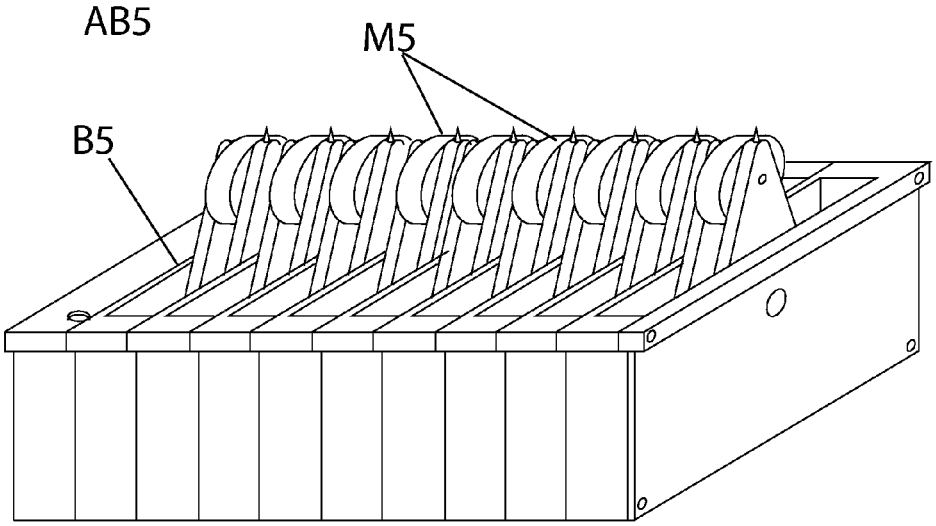
FIG. 49 schematically shows a bank of mechanisms perspective view according to an invention fifth embodiment.
Figure 50:
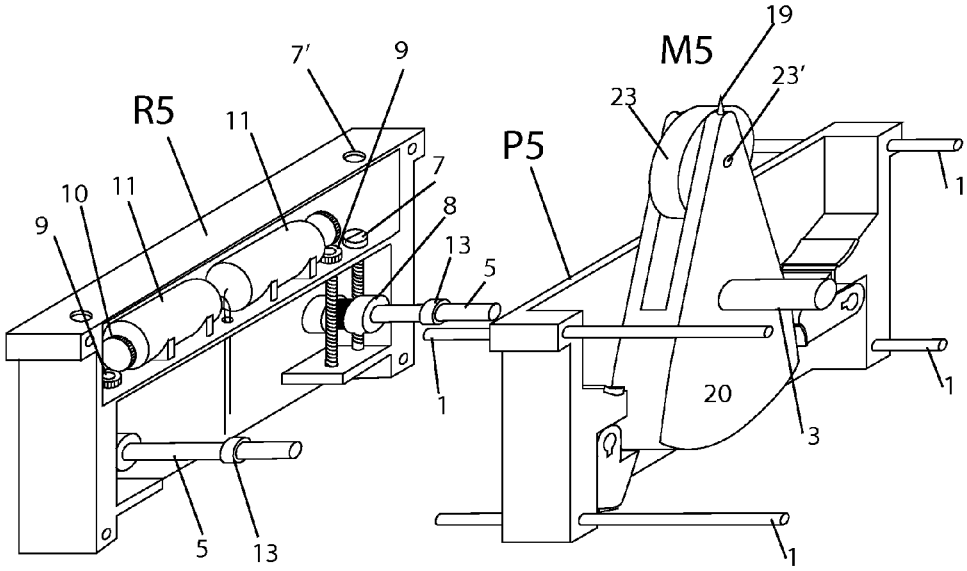
FIG. 50 schematically shows an enlarged perspective view in separate parts, in which details of the embodiment shown in FIG. 49 are illustrated.
Figure 51:
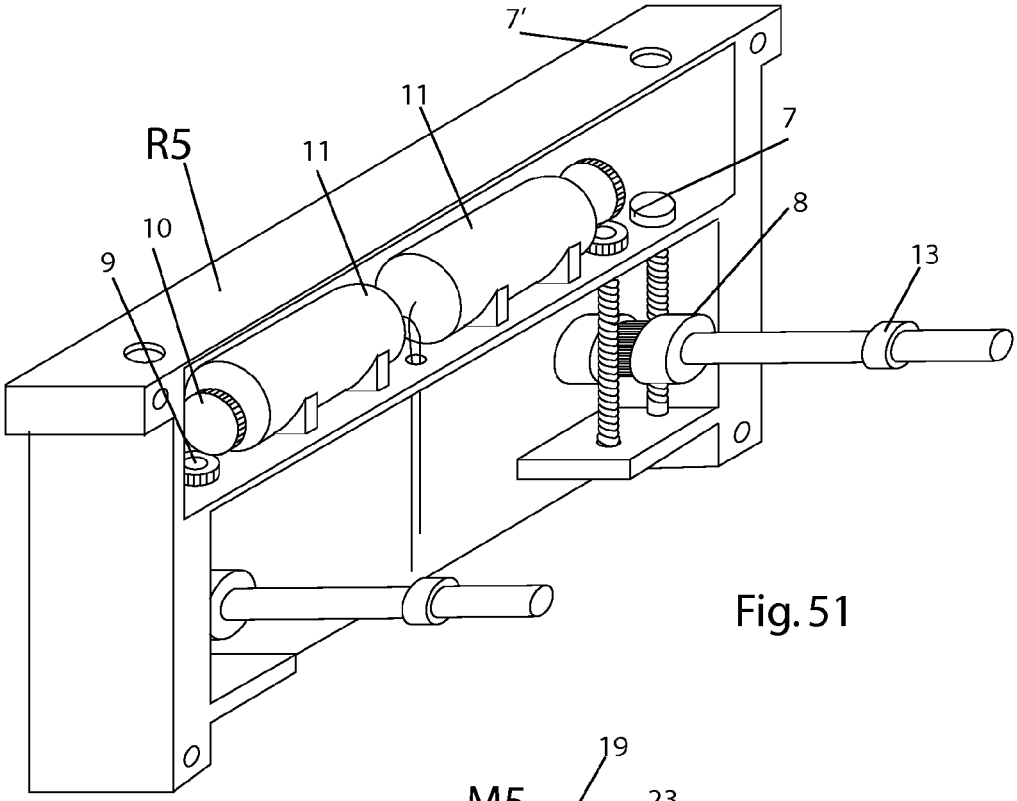
FIG. 51 schematically shows a perspective view of the mechanisms control device of the embodiment shown in FIG. 49, mounted on an end vertical wall.
Figure 52:
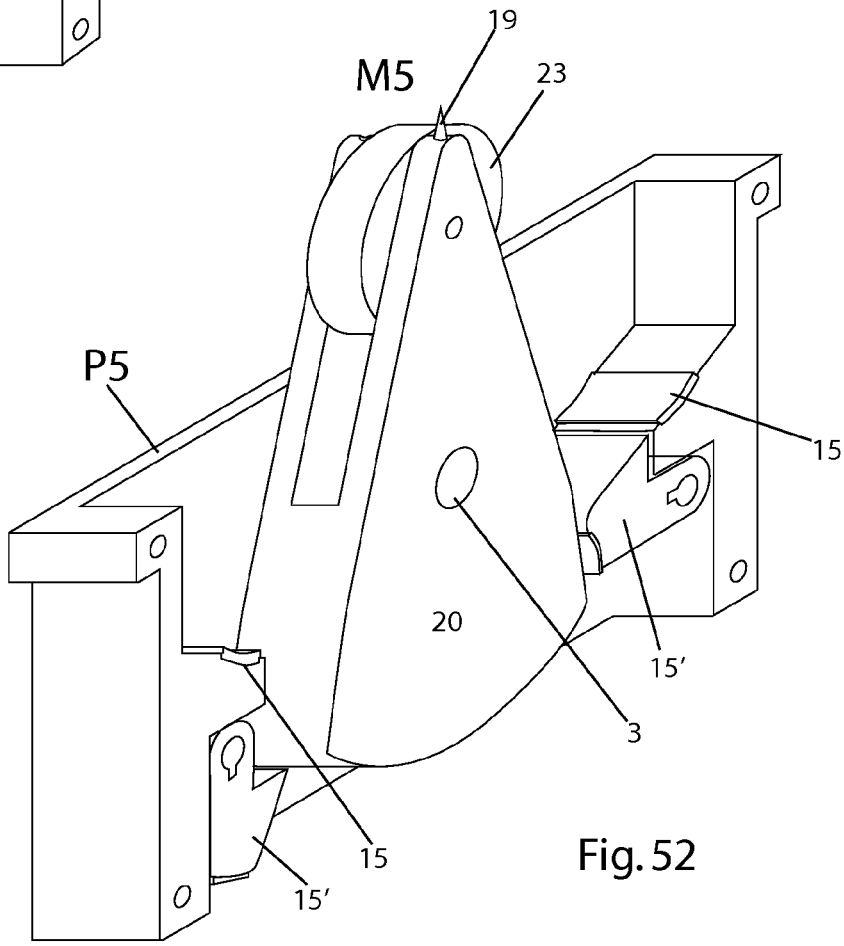
FIG. 52 schematically shows a perspective view of the mechanism of the embodiment shown in FIG. 49, mounted on the respective intermediate vertical wall.
Figure 53:
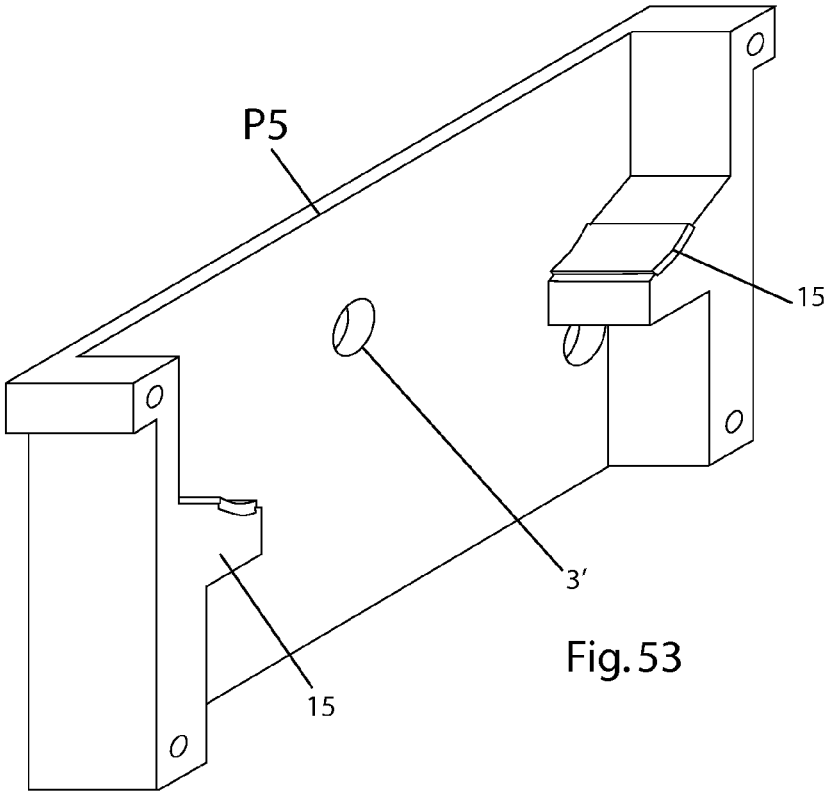
FIG. 53 schematically shows a perspective view of an intermediate vertical wall of the bank of mechanisms of the embodiment shown in FIG. 49.
Figure 54:
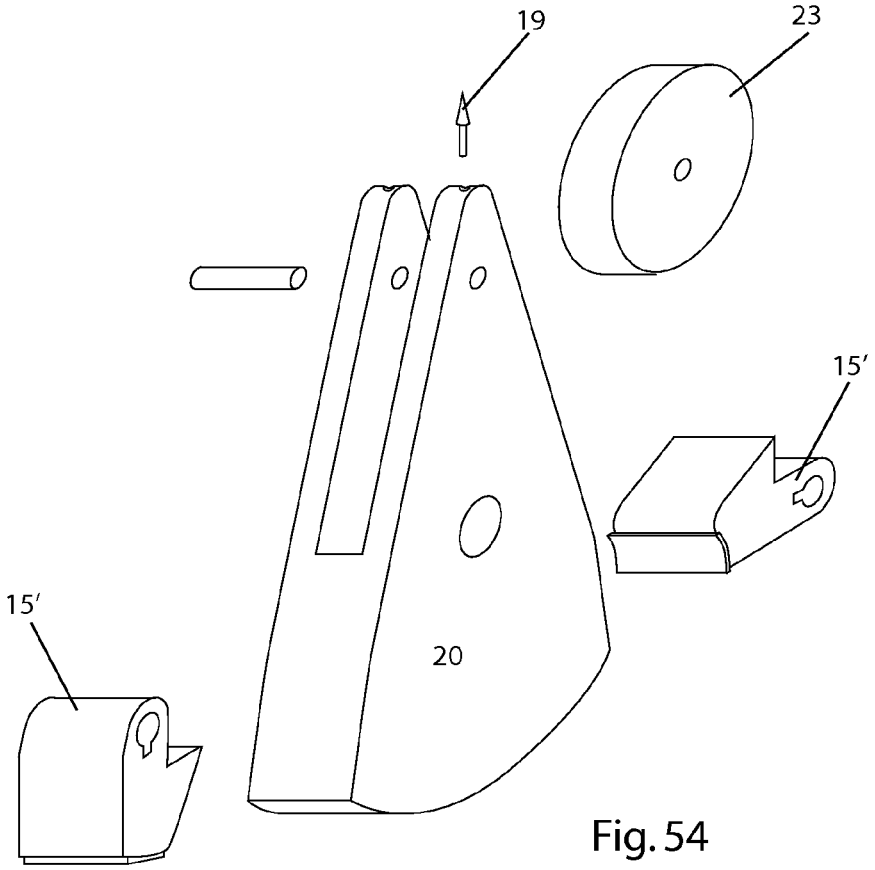
FIG. 54 schematically shows an exploded perspective view of the mechanism of the embodiment shown in FIG. 49.

The bank of mechanisms B4 operates as follows:

when the bank of mechanisms B4, is not being controlled, each mechanism M4, stays in an inactive position, shown in FIG. 42, the two elastic connecting rods 26, 26' being in the balance position due to the eccentric bush 25 is in the position shown in said figure, so that the tyres R of a vehicle can step the bank of mechanisms in any direction it has no action on said tyres R;

when the control device drives the mechanisms M4, so that the eccentric bush stays in one of the normal operation positions, shown in FIG. 43 or in a symmetrical position, shown in FIG. 47, i.e. it moves to the left or to the right in order to contact the stop triangular piece 26, due to the unbalance caused by the eccentric piece 25 in the respective elastic connecting rods 26, 26', which either drives the mobile piece 20 in its left or right portion, causes each mobile rollers 23 to protrude from the top of the intermediate vertical wall P4 on the right shown in FIG. 43, or on the left shown in FIG. 47;

when a vehicle tyre R threads on the device in the appropriated or allowed travelling direction, shifts at least one of the mobile rollers 23 into respective cell, in accordance with FIG. 44 or in accordance with FIG. 48, not taking the mechanism M4 any perceptible action on tyre R;

when a vehicle tyre R threads on the bank of mechanisms B4 in the wrong or forbidden travelling direction, shown in FIG. 45 or in FIG. 46, it impacts at least against one removable spike 19, it punctures the tyre R, which then gets support on a mobile roller 23. The mobile roller 23 forms a slippery barrier for the tyre R which together with the removable spike 19 causes tyre R tearing and therefore the vehicle immobilization.

Each mechanism M5 of the bank of mechanisms B5 according to the invention, depicted in FIGS. 49 to 60, is a reversible mechanism, i.e. it allows the selection of the travelling interdiction direction. Each mechanism M5, depicted in more detail in FIGS. 50 to 56, consists of a mobile piece 20, having a removable spike 19; a mobile roller 23 mounted on a shaft 23' in said mobile piece 20; a shaft 3 common to the other mechanisms M5, housed in the other cells of the bank of mechanisms B5 supports said mobile piece 20, two stops 15 arranged on the opposite inner sides of the intermediate vertical wall P5 and which surfaces provided with a damping and noise reduction element serve as a stop to said roller 23; two control devices each consisting of one bush 8 having peripherally and centrally a cogged recess; a manual driver 7 consisting of a screw acting on said bush 8 cogged recess and a motorized actuator 11, consisting of one engine that operates a head 9 of a screw through a gear wheel 10, the screw in turn acting on said bush 8 cogged recess; the common shaft 5 crossing said vertical walls R5, P5 and T5 through respective holes, on said common shaft 5 and joined to it by a indentation being mounted respectively the bushes 8, 13 and the mobile stops 15', which surfaces, provided with a damping and noise reduction element, acts as a stop to said mobile piece 20.

Figure 55:
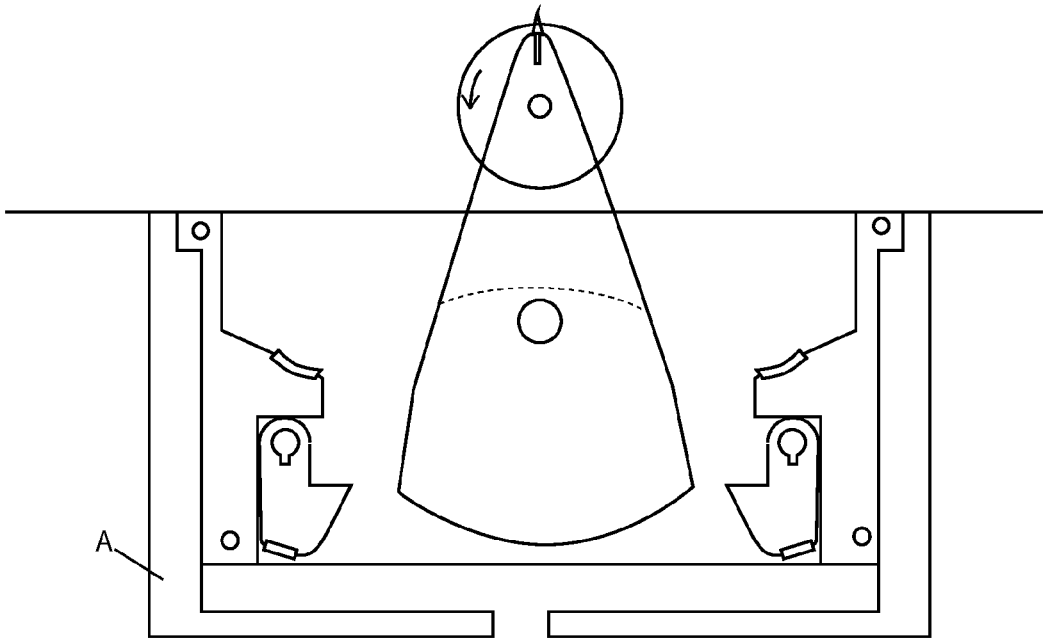
FIGS. 55 and 56 schematically show a side elevation view of a mechanism and respective intermediate vertical wall the embodiment shown in FIG. 49, respectively in an inactive position and in an active position.
Figure 56:
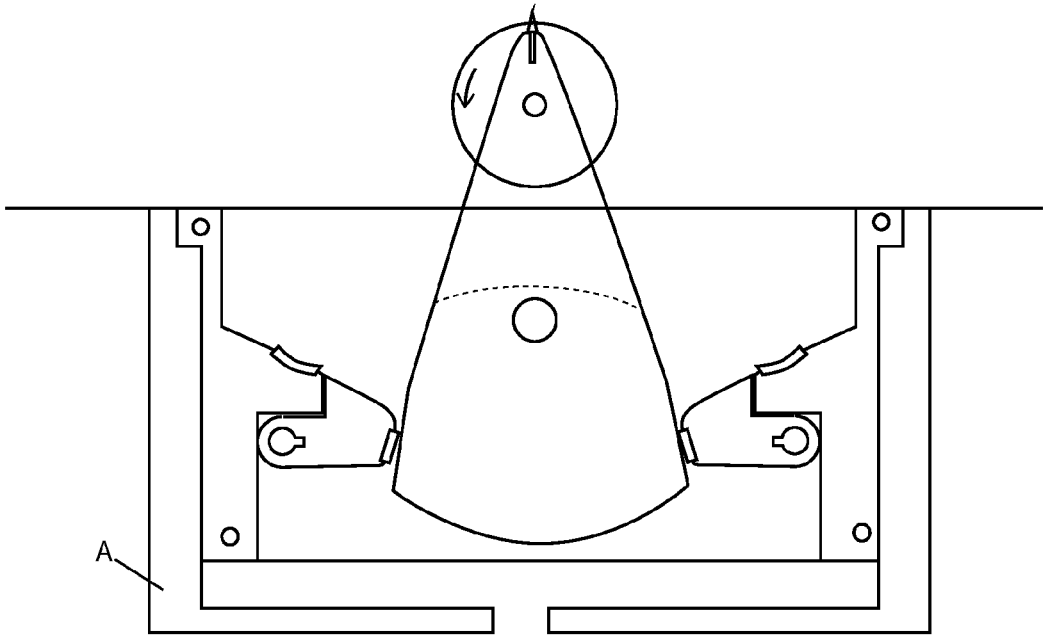
Figure 57:
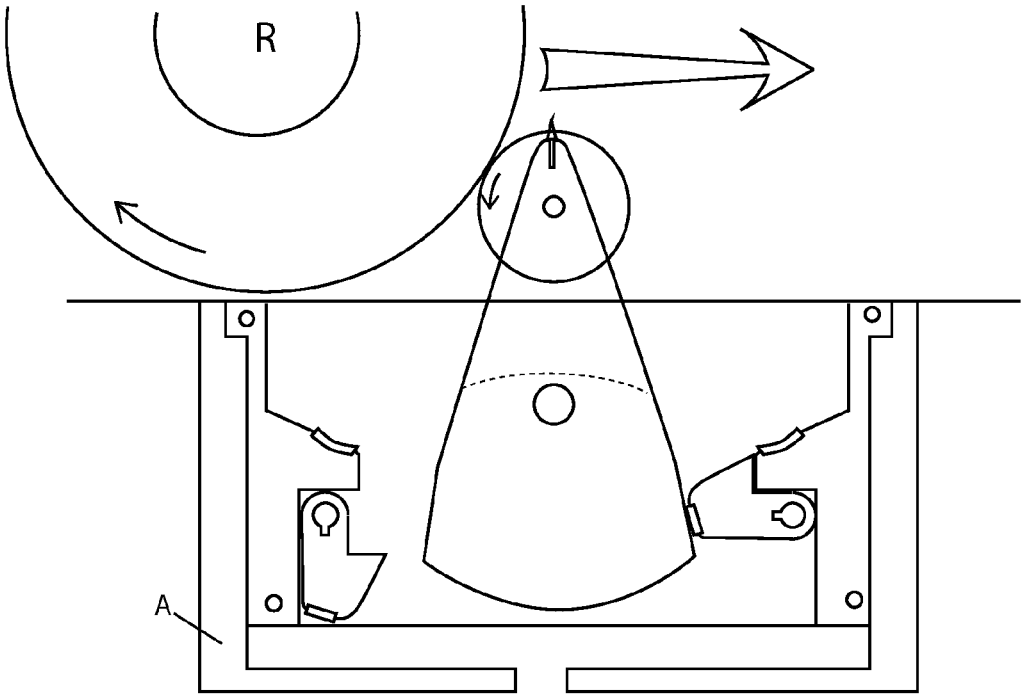
FIGS. 57 to 60 schematically show the operating mode of the embodiment shown in FIG. 49.
Figure 58:
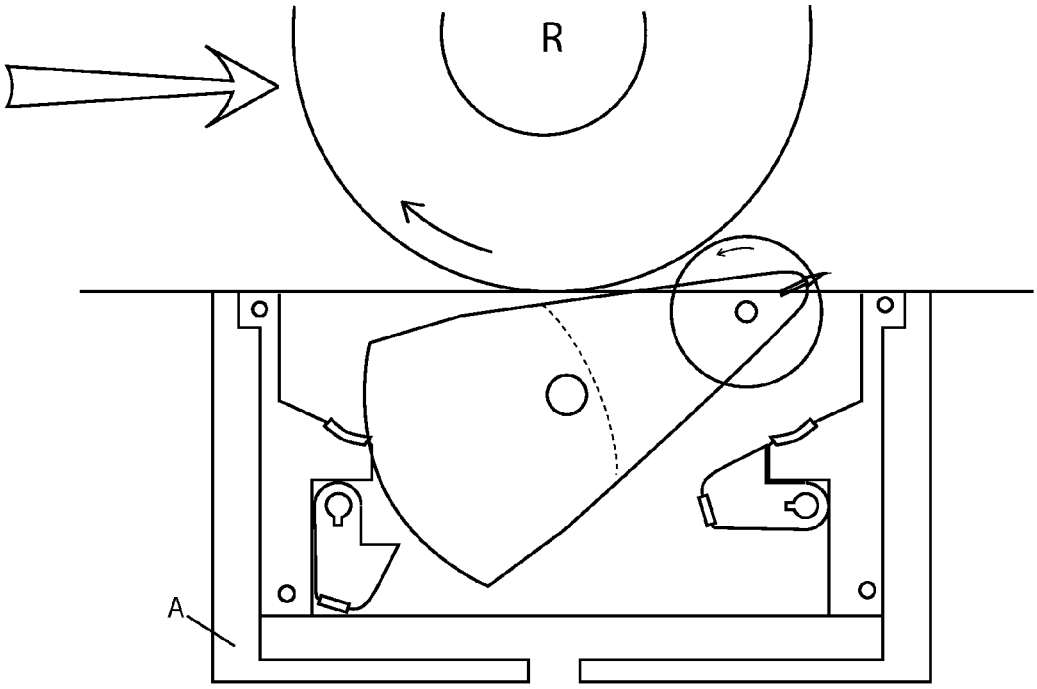
Figure 59:
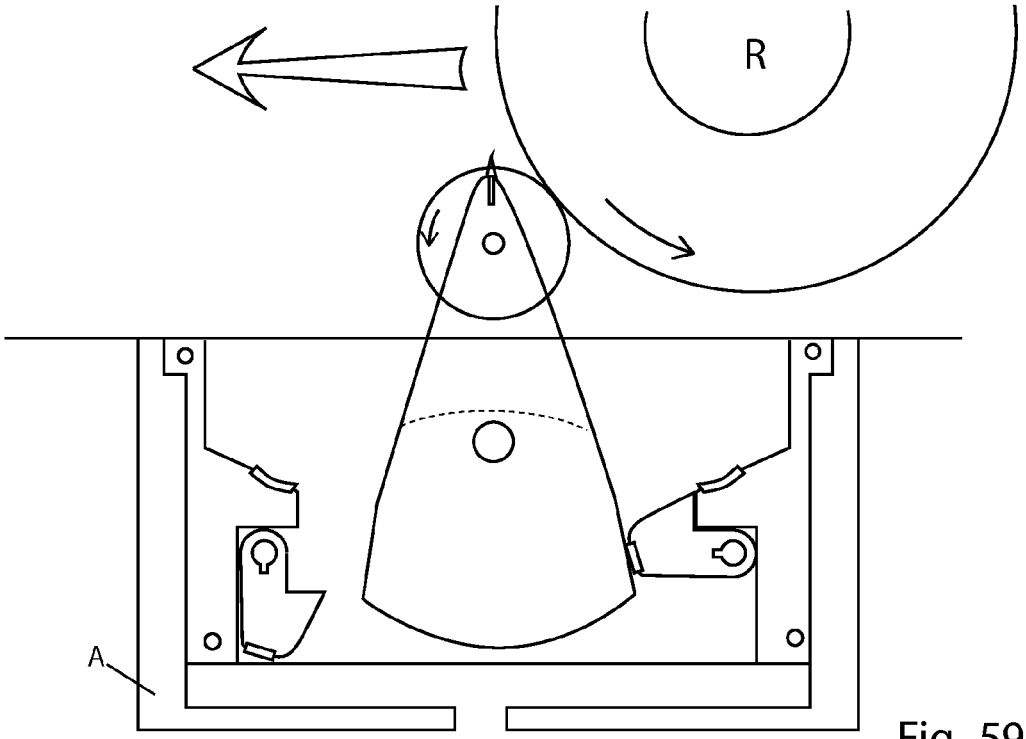
Figure 60:
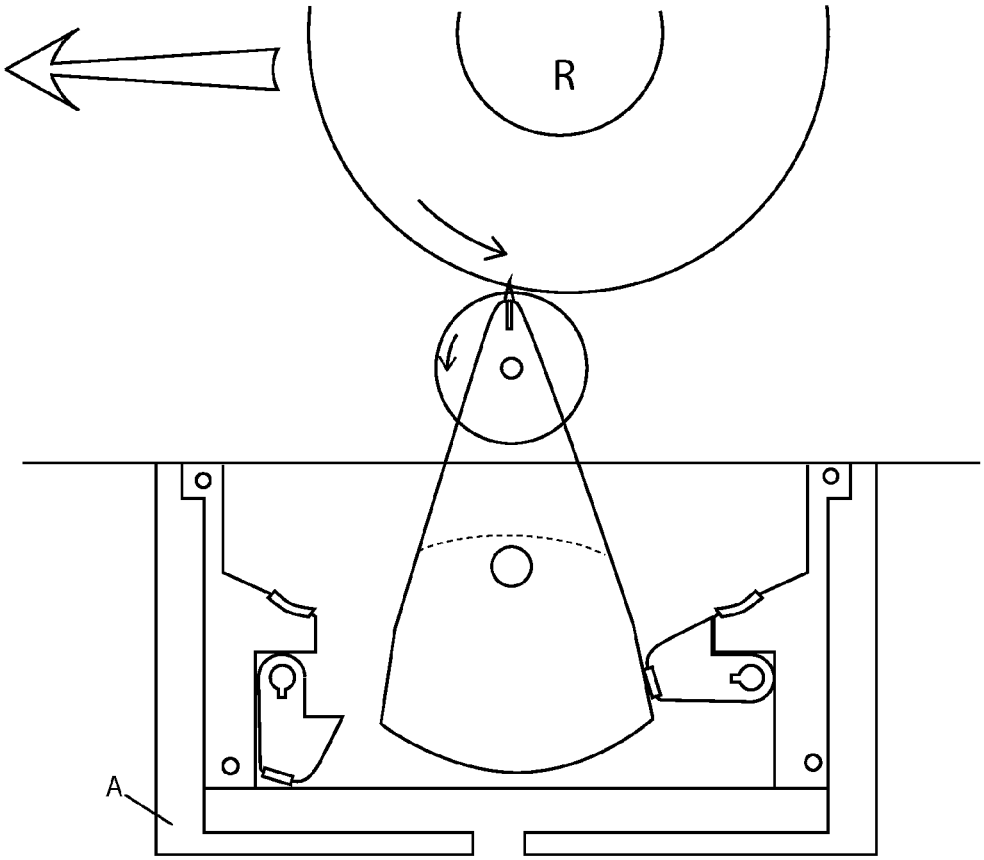

The bank of mechanisms B5 operates as follows:

when the bank of mechanisms B5 is deactivated to both directions each mechanism M5 stays in one inactive position shown in FIG. 55, the vehicles movement is allowed to any direction in relation to the bank of mechanisms B4, so that the tyres R of a vehicle can thread on and act on the bank of mechanisms in any direction that it does not take action on tyres R;

when the control device places the two mobile stops 15' in the position shown in FIG. 56, the mobile piece 20 is blocked and the mechanisms M5 prevent the vehicles movement in any direction in relation to the bank of mechanisms B4, so that a vehicle tyre R attempting to transpose the device in any travelling direction collides against at least one mobile roller 23, causing loss of adherence in the case of being a driving wheel, and depending on the scale of the mechanism embodiment may or not prevent the vehicle displacement; if the tyre R can pass through the mobile roller 23 it will be punctured by the removable spike 19, which causes the tyre tearing and therefore the vehicle immobilization;

when the control device places the mechanisms M5 as illustrated in FIG. 57, with the mobile stop 15' on the right up the mechanism stays in the active position shown in this figure, being allowed the displacement of vehicles on the arrow direction. When a vehicle tyre R threads on the device in the appropriated movement direction, collides at least against one mobile roller 23 in the direction shown in FIG. 57, but this mobile roller moves to the stop 15 (see FIG. 58) and abuts it, so that the mechanism M5 does not take any action on said tyre R;

when a vehicle tyre R threads on the bank of mechanisms B5 in the wrong or forbidden displacement direction, shown in FIG. 59, the mobile piece 20 stays blocked due to the action of the right stop 15', so that said tyre R collides at least against one mobile roller 23 which is a slippery barrier for the tyre R and if the tyre R could pass through the mobile roller 2 will be punctured by the removable spike 19, which causes the tyre R tearing and therefore the vehicle immobilization.

Figure 61:
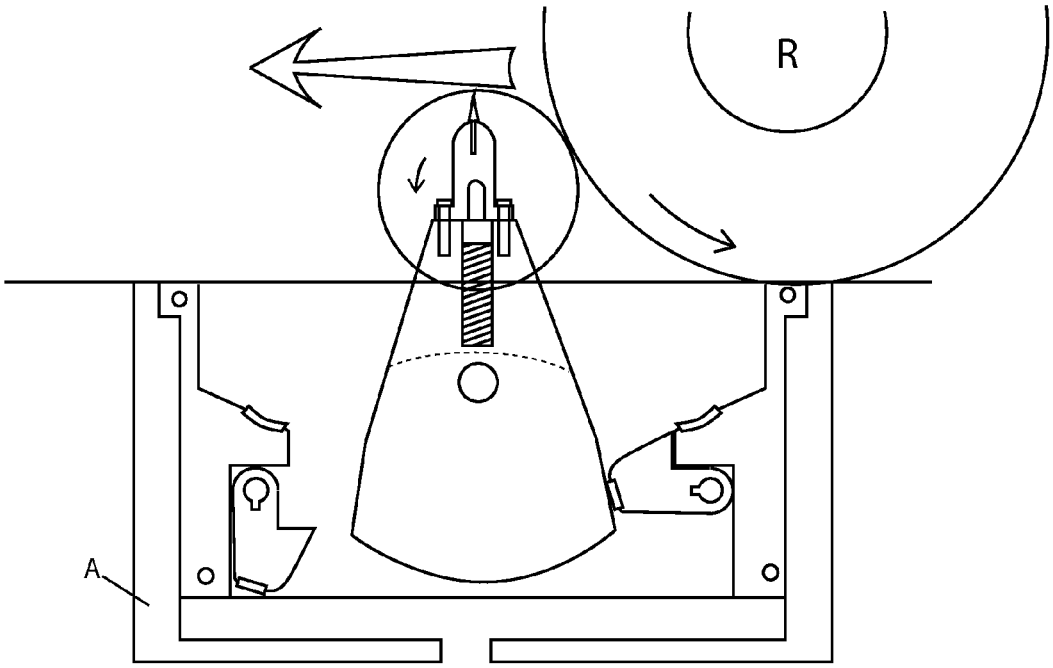
FIGS. 61 and 62 schematically show in side elevation a variant of the embodiment shown in FIG. 49, as well as its operating mode.
Figure 62:
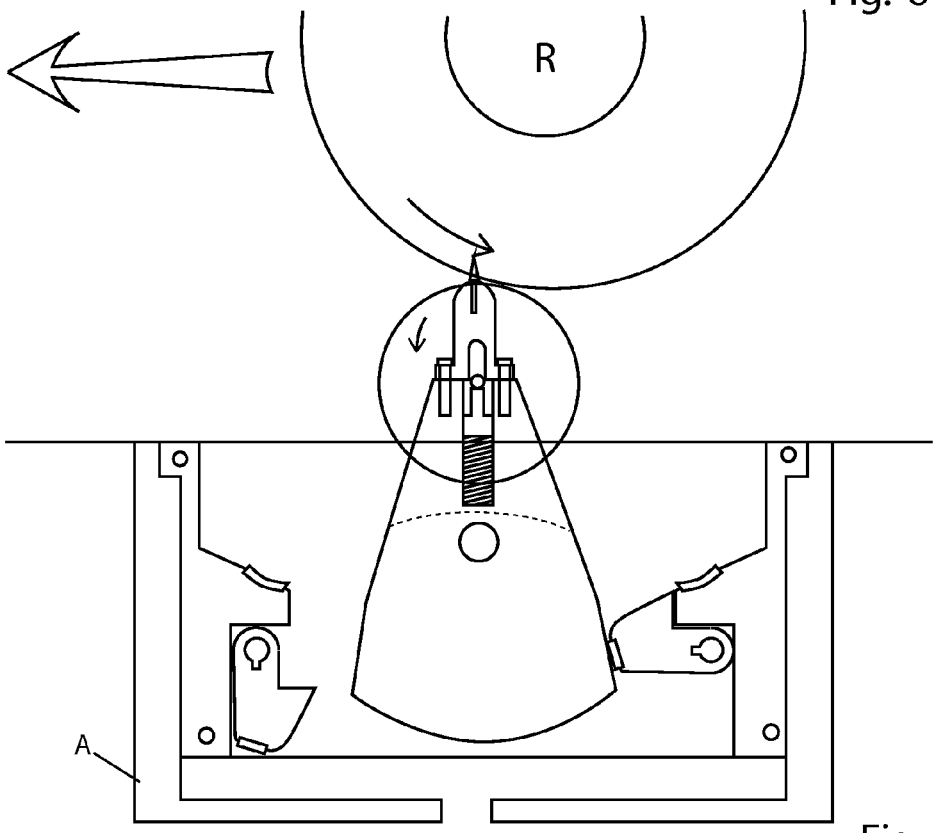

FIGS. 61 and 62 show a variant of the mobile roller 23 assembly, in which the shaft 23' is mounted in a slot and is pressed upwards by a spring 23", which causes the spike 19 stays hidden when the mobile roller 23 is not biased in the downward direction. When the mobile roller is biased in the downward direction by a tyre R (see FIG. 62), the spike protrudes and punctures the tyre R.

Figure 63:
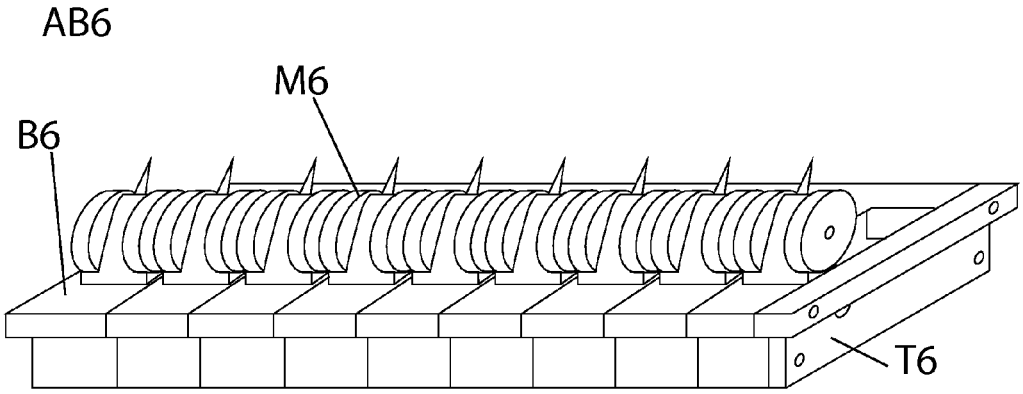
FIG. 63 schematically shows a bank of mechanisms perspective view according to a sixth embodiment of the invention.
Figure 64:
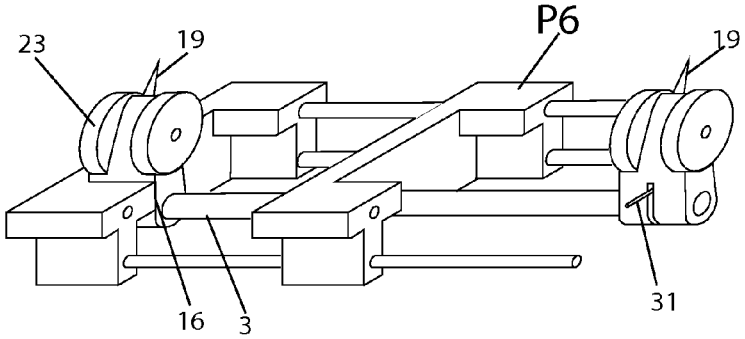
FIG. 64 schematically shows an enlarged perspective view in separate parts, in which details of the embodiment shown in FIG. 63 are illustrated.
Figure 65:
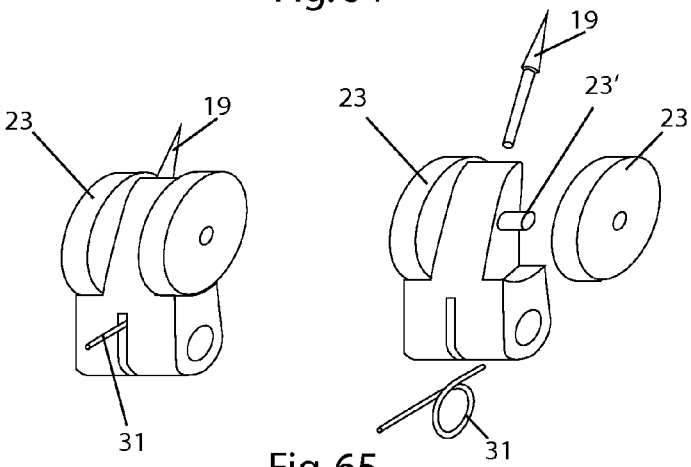
FIG. 65 schematically shows a mechanism mobile piece perspective view of the embodiment shown in FIG. 63 and another perspective view in separate parts of the same mobile piece.

Each mechanism M6 of the bank of mechanisms B6, depicted in FIG. 63 and with more detail in FIG. 64, consists of a mobile piece 20 having a removable spike 19; two mobile rollers 23 each mounted on a shaft 23' in said mobile piece 20; a return spring 31; a shaft 3 common to the other mechanisms M6 housed in the other cells of the bank of mechanisms B6, which supports said mobile piece 20 and said return spring 31; a stop 16 arranged on the inner side of the vertical wall P6 near said common shaft 3, and which surface provided or not with a damping and noise reduction element serves as a stop to said mobile piece 20 and presents said mobile piece 20 on its lower portion central zone a slot, where is housed said spring 31, one end of which keeping the mobile piece under pressure abutted against the stop 16.

Figure 66:
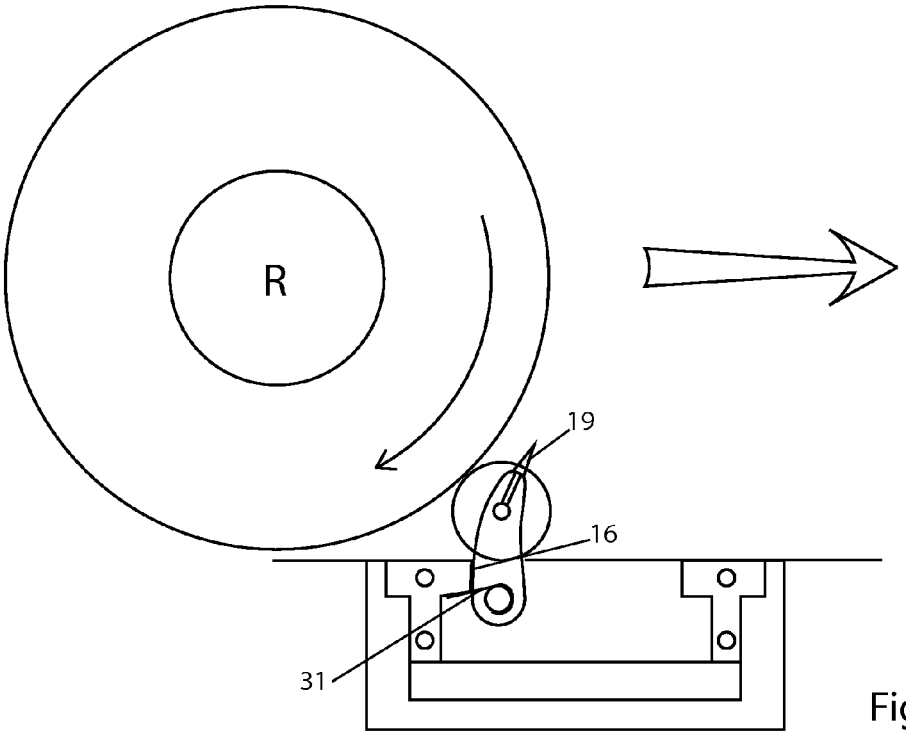
FIGS. 66 to 69 schematically show the operating mode of the embodiment shown in FIG. 63.
Figure 67:
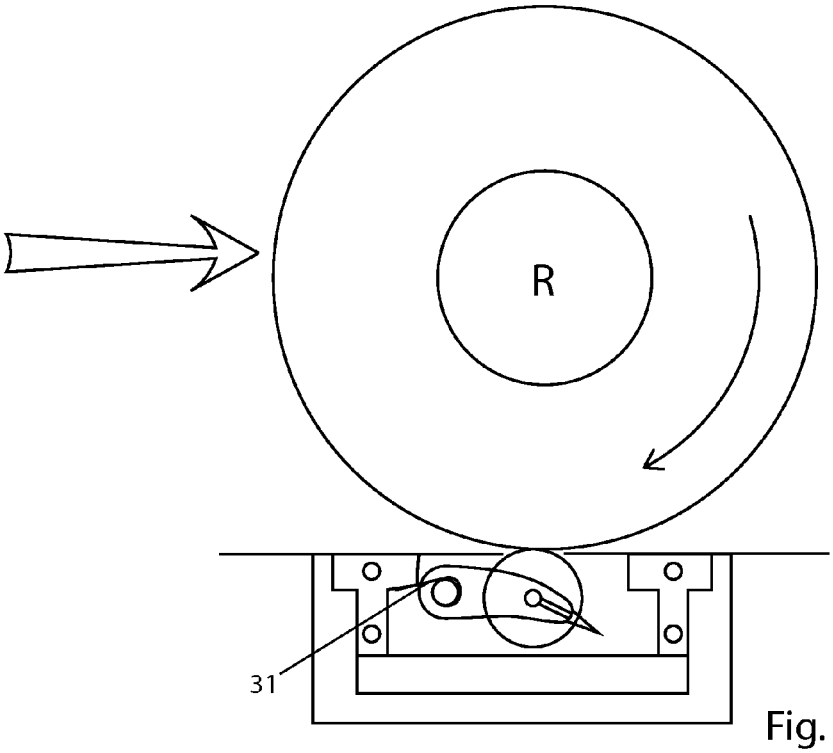
Figure 68:
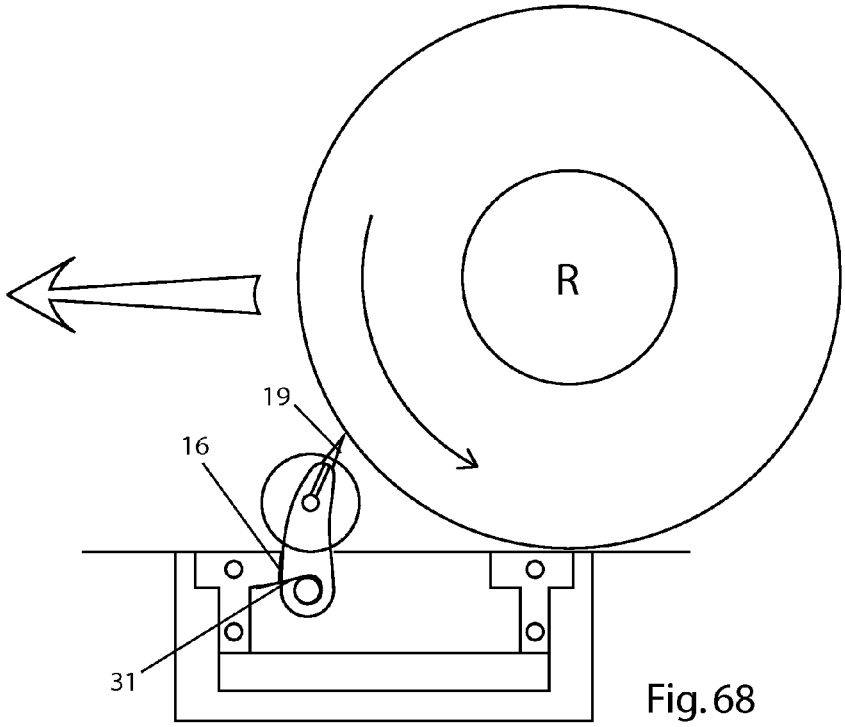
Figure 69:
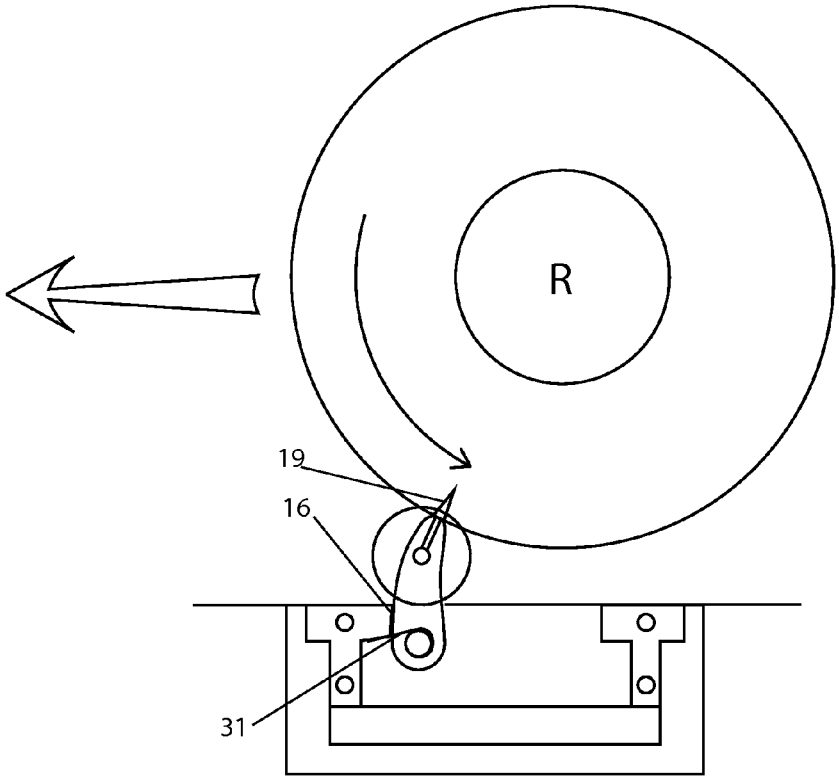

The bank of mechanisms B6 operates as follows:

when there is no action on a bank of mechanisms B6 each mechanism is in the position shown in FIG. 63, by the action of said spring 31;

when a vehicle tyre R threads on the device in the appropriated or allowed travelling direction, shifts at least one mobile roller 23 which moves into the bank of mechanisms B6, see FIGS. 66 and 67, having no perceptible action on the tyre R;

when a vehicle tyre R threads on the device in the wrong or forbidden travelling direction it collides against the jaw 19 and the tyre R being punctured (see FIGS. 68 and 69); keeping the displacement, the tyre R gets support on the mobile roller 23, acting as a barrier to the tyre R, which slides on the mobile roller 23, so that the jaw 19 causes the tyre R tearing and therefore the vehicle immobilization.

Figure 70:
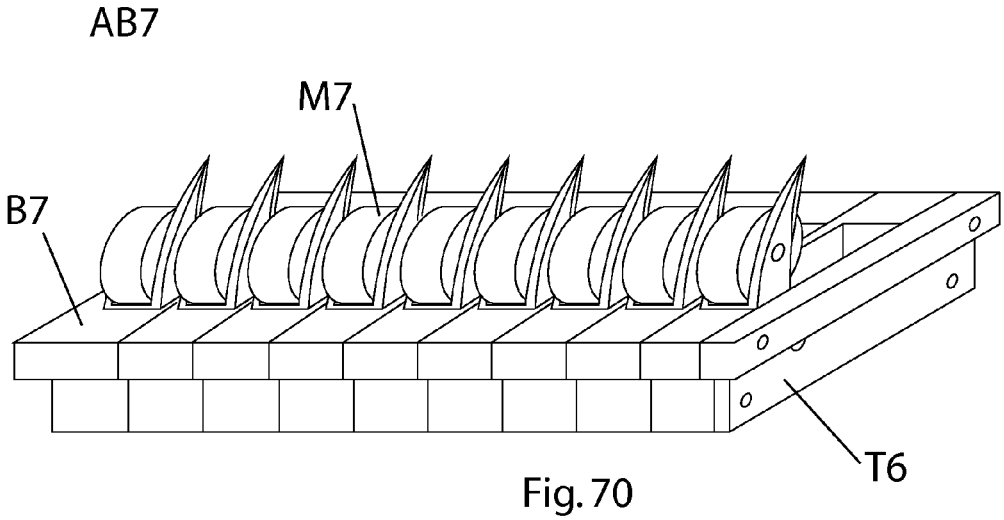
FIG. 70 schematically shows a bank of mechanisms perspective view in accordance with a seventh invention embodiment.
Figure 71:
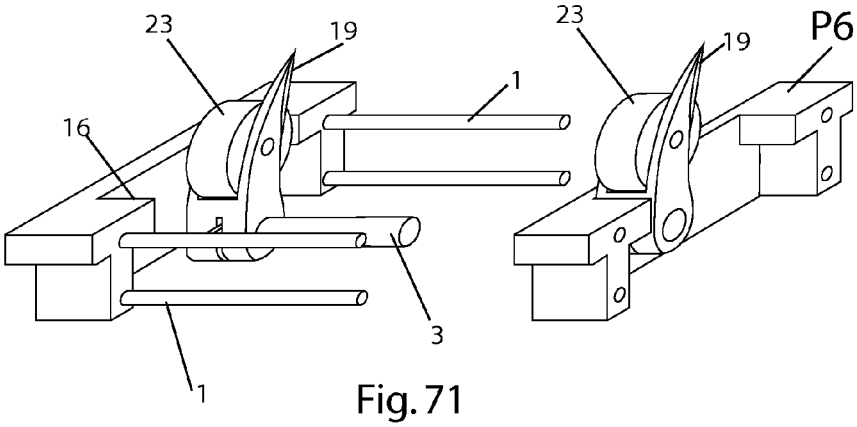
FIG. 71 schematically shows an enlarged perspective view in separate parts, in which details of the embodiment shown in FIG. 70 are illustrated.
Figure 72:
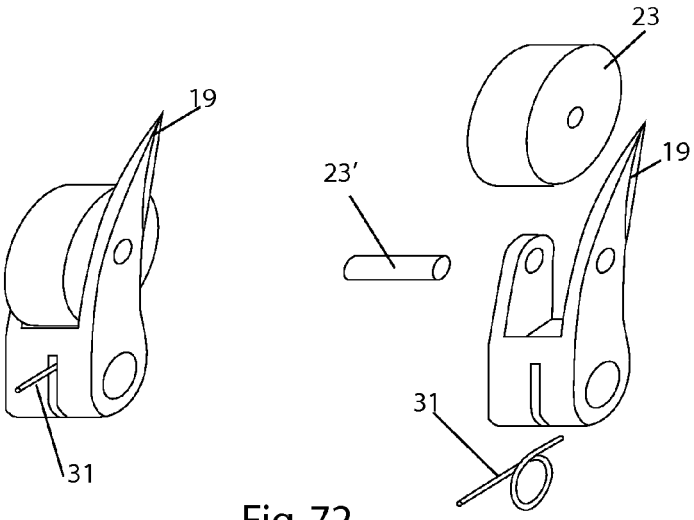
FIG. 72 schematically shows a perspective view of the mechanism mobile piece of the embodiment shown in FIG. 63 and another perspective view in separate parts of the same mobile piece.

Each mechanism M7 of the bank of mechanisms B7, depicted in FIG. 70 which is depicted in more detail in FIGS. 71 and 72 consists of a mobile piece 20 having a fixed spike 19; a mobile roller 23 mounted on a shaft 23' in said mobile piece 20; a return spring 31; a shaft 3 common to the other mechanisms M7 housed in the other cells of the bank of mechanisms B7 supports said mobile piece 20 and said return spring 31; a stop 16 arranged on the inner side of the vertical wall P6 near said common shaft 3 and which surface provided or not with a damping and noise reduction element serves as a stop to said mobile piece 20; and said mobile piece 20 having in its lower portion central zone a slot where is housed said spring 31 which end keeps the mobile piece under pressure abutted against the stop 16.

Figure 73:
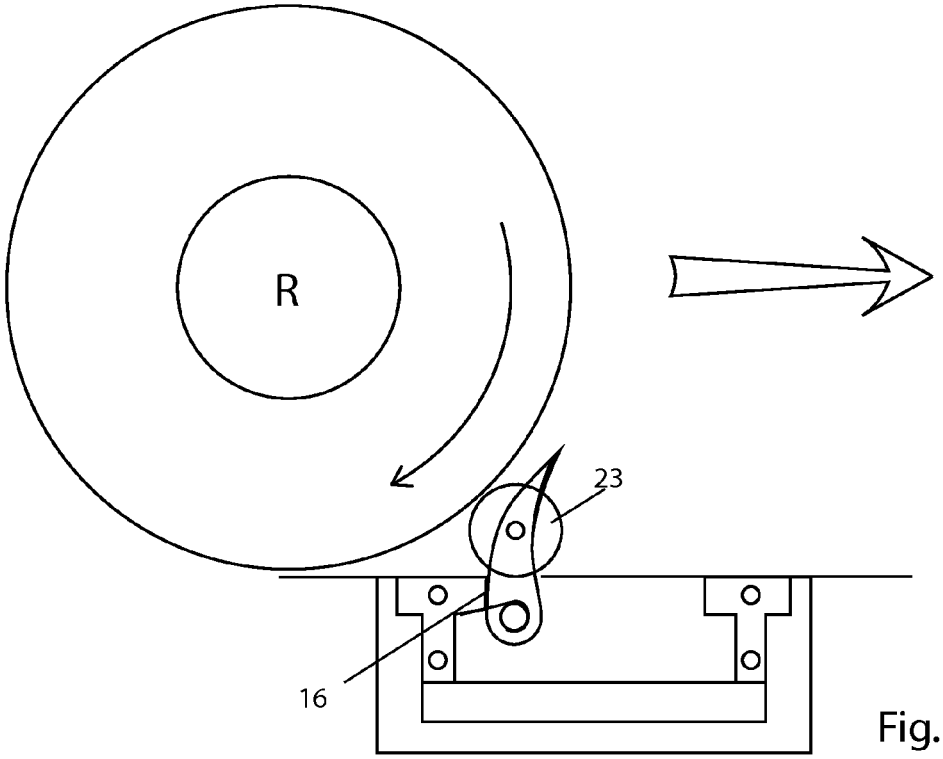
FIGS. 73 to 76 schematically show the operating mode of the embodiment shown in FIG. 63.
Figure 74:
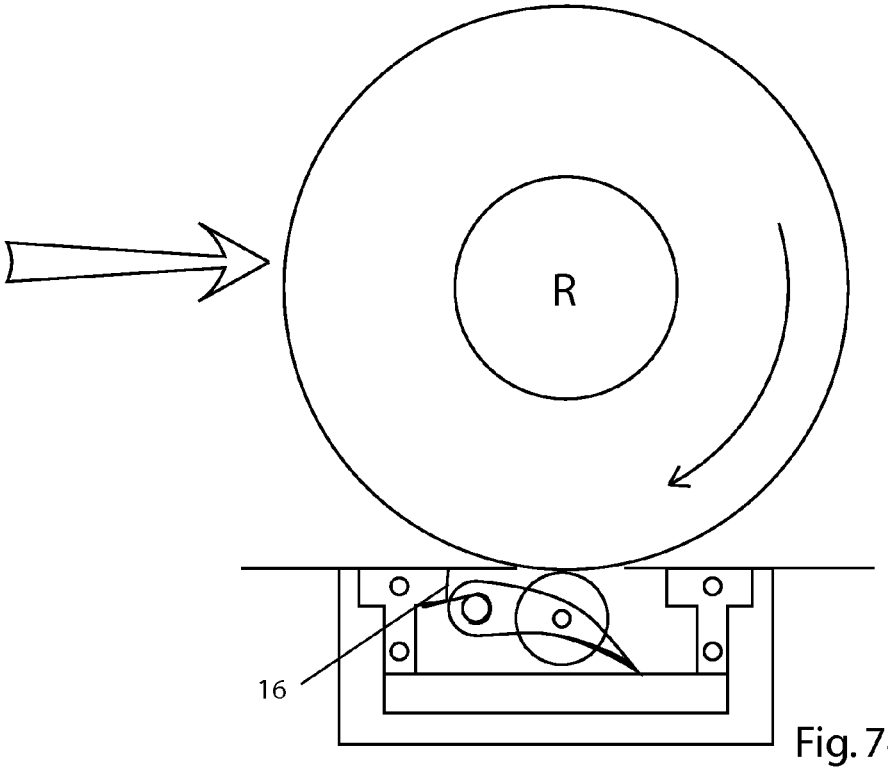
Figure 75:
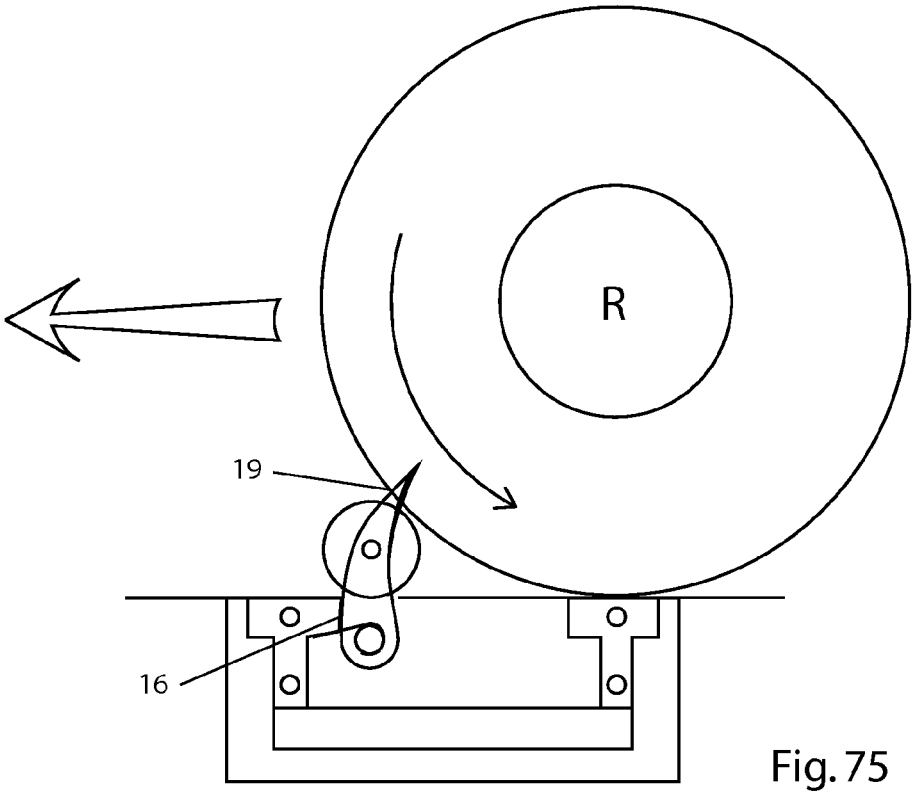

The bank of mechanisms B7 operates as follows:

when there is no action on a bank of mechanisms B7 each mechanism is in the position shown in FIG. 73 by the action of said spring 31;

when a vehicle tyre R threads on the device in the appropriated or allowed travelling direction shifts at least one mobile roller 23, which moves into the bank of mechanisms B7 (see FIGS. 73 and 74) having no perceptible action on the tyre R;

when a vehicle tyre R threads on the device in the wrong or forbidden travelling direction it collides against the jaw 19 and the tyre R being punctured (see FIGS. 75 and 76); keeping the displacement the tyre R gets support on the mobile roller 23, acting as a barrier to tyre R, which slides on the mobile roller 23 so that the jaw 19 causes the tyre R tearing and therefore the vehicle immobilization.

FIGS. 77 and 78 show practical implementation examples of the bank of mechanisms exemplified in the figures above.

The invention devices may be associated with any other electronic devices for detecting vehicles, which may include at least one traffic light of red lights and where appropriate. The devices according to the invention when provided with motorized control may be controlled by remote control, which in turn can be activated by the frequency used by emergency services and fire brigades or the police to allow the use, for example, by ambulances, fire brigades vehicles or police vehicles to roads accessing highways safely in the unauthorized direction, i.e. the wrong direction.

The application of these devices is for four-wheeled vehicles because is admitted it may has some impact on two-wheel vehicles and on other hand is also recognized the movement of this latter vehicles in the wrong direction is dangerous only for such vehicles and their drivers, besides being much easier for such vehicles return the appropriated direction in case of error.

To avoid interference with the movement of two-wheeled vehicles the application of these devices should leave adequate spaces for their movement, but at the same time do not allow any car to cross a given area of barriers without having to thread on the device at least with two wheels.

While the above invention discussion is based on a given number of embodiments, it is obvious it is not limited to such embodiments, but can be modified in many ways without departing from the scope of the following claims.

The invention claimed is:

1. A device embedded in the pavement of a road for halting and/or preventing the traffic of motor vehicles in an opposite direction to an allowed traveling direction, comprising:

a drained box embedded in a roadway, at least one bank of mechanisms mounted inside the drained box the at least one bank of mechanisms having a first end wall and a second end wall;

a plurality of vertical walls between the first end wall and the second end wall, wherein the plurality of vertical walls, the first end wall and the second end, each have a top portion for supporting at least one vehicle tire, and are arranged parallel to each other in a same direction as an axis of the roadway;

a plurality of screwed rods extending from the first end wall and the second end wall and joining the plurality of vertical walls;

a plurality of cells defined by the plurality of vertical walls, and first and second end walls;

a plurality of common horizontal shafts supported by the first end wall and the second end wall and crossing the plurality of vertical walls; and a plurality of driving mechanisms, wherein each driving mechanism further comprises:

a mobile piece, having a removable spike;

a mobile roller mounted on a first shaft of said mobile piece;

a second shaft of said mobile piece common to the other driving mechanisms housed in the other cells of the at least one bank of mechanisms;

a first stop for said mobile roller arranged on an inner side of one of the plurality of vertical walls proximate said removable spike; and a second stop for said mobile piece arranged on a lower side of one of the plurality of vertical walls distal said removable spike, wherein each of the plurality of driving mechanisms is housed in one of the plurality of cells and is activated from a first position to a second position by at least one vehicle tire transposing or attempting to transpose said driving mechanism.

2. The device according to claim 1, further comprising:

a control device on at least one of the first end wall and the second end wall, said control device comprising:

a first bush having a peripherally and centrally cogged recess;

a manual driver screw actuating said cogged recess;

a motorized driver including an engine that operates a head of a screw through a gear wheel, the screw actuating said cogged recess;

a plurality of second bushes mounted on at least one of said common horizontal shafts and crossing said vertical walls, each of said plurality of second bushes associated with one of said driving mechanisms;

a plurality of resending pulleys being mounted on said at least one common horizontal shaft and associated with one of said driving mechanisms;

a plurality of elastic connecting rods, one of said plurality of elastic connecting rods associated with one of said plurality of second bushes and one of said driving mechanisms, wherein each of said plurality of elastic connecting rods further comprises:

an elastic helical spring fixed between a first inelastic rod portion and a second inelastic rod portion, wherein said first inelastic rod portion wraps around one of the plurality of resending pulleys and connects to said mobile piece of said associated driving mechanism, and said second inelastic rod portion connects to said associated one of said plurality of second bushes; and a spring associated with said mobile piece of said associated driving mechanism and fixed at a first end to said mobile piece by means of a third shaft and at a second end to a fourth shaft on one of said plurality of vertical walls.

3. The device according to claim 1, wherein said device is associated with an electronic device on at least one traffic light to detect vehicles in an opposite direction.

4. The device according to claim 1, said device is associated with a driving remote control device remote control, activated by a frequency used by emergency services and police.

* * * * *